US007867114B2

(12) United States Patent
Sutherland et al.

(10) Patent No.: US 7,867,114 B2
(45) Date of Patent: Jan. 11, 2011

(54) MULTI-WALLED TUBULAR BASEBALL BATS WITH BARREL INSERTS OF VARIABLE GEOMETRY

(75) Inventors: Terrance William Sutherland, Ottawa (CA); Stephen Fitzgerald, Ottawa (CA); Frederic St. Laurent, Val des Monts (CA)

(73) Assignee: CE Composites Baseball Inc.

( * ) Notice: Subject to any disclaimer, the term of this patent is extended or adjusted under 35 U.S.C. 154(b) by 261 days.

(21) Appl. No.: 11/740,519

(22) Filed: Apr. 26, 2007

(65) Prior Publication Data

US 2007/0254752 A1 Nov. 1, 2007

Related U.S. Application Data

(63) Continuation-in-part of application No. 10/672,060, filed on Sep. 29, 2003, now abandoned.

(60) Provisional application No. 60/745,806, filed on Apr. 27, 2006.

(51) Int. Cl.
*A63B 59/06* (2006.01)

(52) U.S. Cl. ..... 473/567

(58) Field of Classification Search ..... 473/457, 473/519–520, 564–568
See application file for complete search history.

(56) References Cited

U.S. PATENT DOCUMENTS 3,861,682 A * 1/1975 Fujii ..... 473/520
3,963,239 A 6/1976 Fujii
4,186,923 A 2/1980 Garner et al.
4,331,330 A 5/1982 Worst
4,848,745 A 7/1989 Bohannan et al.
4,919,438 A 4/1990 Yoneeyama
5,094,453 A 3/1992 Douglas et al.
5,303,917 A 4/1994 Uke
5,364,095 A 11/1994 Easton et al.
5,415,398 A 5/1995 Eggiman
5,964,673 A * 10/1999 MacKay, Jr. ..... 473/566
6,042,493 A 3/2000 Chauvin et al.
6,053,828 A 4/2000 Pitsenberger
6,251,034 B1 6/2001 Eggiman et al.
6,425,836 B1 7/2002 Misono et al.
6,440,017 B1 8/2002 Anderson
6,461,260 B1 10/2002 Higginbotham
6,497,631 B1 12/2002 Fritzke
6,612,945 B1 9/2003 Anderson
6,733,404 B2 5/2004 Fritzke et al.

(Continued)

*Primary Examiner*—Mark S Graham
(74) *Attorney, Agent, or Firm*—Sheema Khan; Miltons IP

(57) ABSTRACT

A multi-walled, tubular baseball bat has a barrel portion with a mid-section wherein the radial stiffness of the overall barrel wall varies along the barrel length to provide an enlarged sweetspot, improved soft feel and performance, plus unique sounds upon impact. The bat has a frame with a barrel portion of consistent diameter. A secondary member, or members, of tubular form extend internally along the barrel. The secondary member provides the required radial stiffness variation by: 1) variations in the thickness of the wall of the secondary member or by, 2) secondary members with unique geometric external surface profiles or by, 3) the presence of functional air cavities, with or without closed ends, between the main bat frame and the secondary member or members or by, 4) the presence of numerous annular secondary members located side by side less than one-half the length of the barrel portion.

6 Claims, 16 Drawing Sheets

U.S. PATENT DOCUMENTS

| | | | | |
|---|---|---|---|---|
| 6,776,735 | B1 | 8/2004 | Belanger et al. | |
| 6,949,038 | B2 * | 9/2005 | Fritzke | 473/566 |
| 7,534,179 | B1 * | 5/2009 | Vasek et al. | 473/566 |
| 7,534,180 | B1 * | 5/2009 | Vacek et al. | 473/566 |
| 2002/0091022 | A1 * | 7/2002 | Fritzke et al. | 473/566 |
| 2002/0094892 | A1 | 7/2002 | Chauvin et al. | |
| 2003/0004020 | A1 * | 1/2003 | Ogawa et al. | 473/564 |
| 2004/0053716 | A1 * | 3/2004 | Wu | 473/564 |
| 2004/0152545 | A1 | 8/2004 | Fritzke | |
| 2004/0209716 | A1 | 10/2004 | Vacek et al. | |
| 2005/0070384 | A1 | 3/2005 | Fitzgerald et al. | |
| 2006/0025249 | A1 * | 2/2006 | Giannetti et al. | 473/564 |
| 2008/0070726 | A1 * | 3/2008 | Watari et al. | 473/566 |

* cited by examiner

FIG. 2A ( X 2 enlarged)

FIG. 3A ( X 3 enlarged)

FIG. 4B ( X 4B enlarged)

FIG. 4A ( X 4A enlarged)

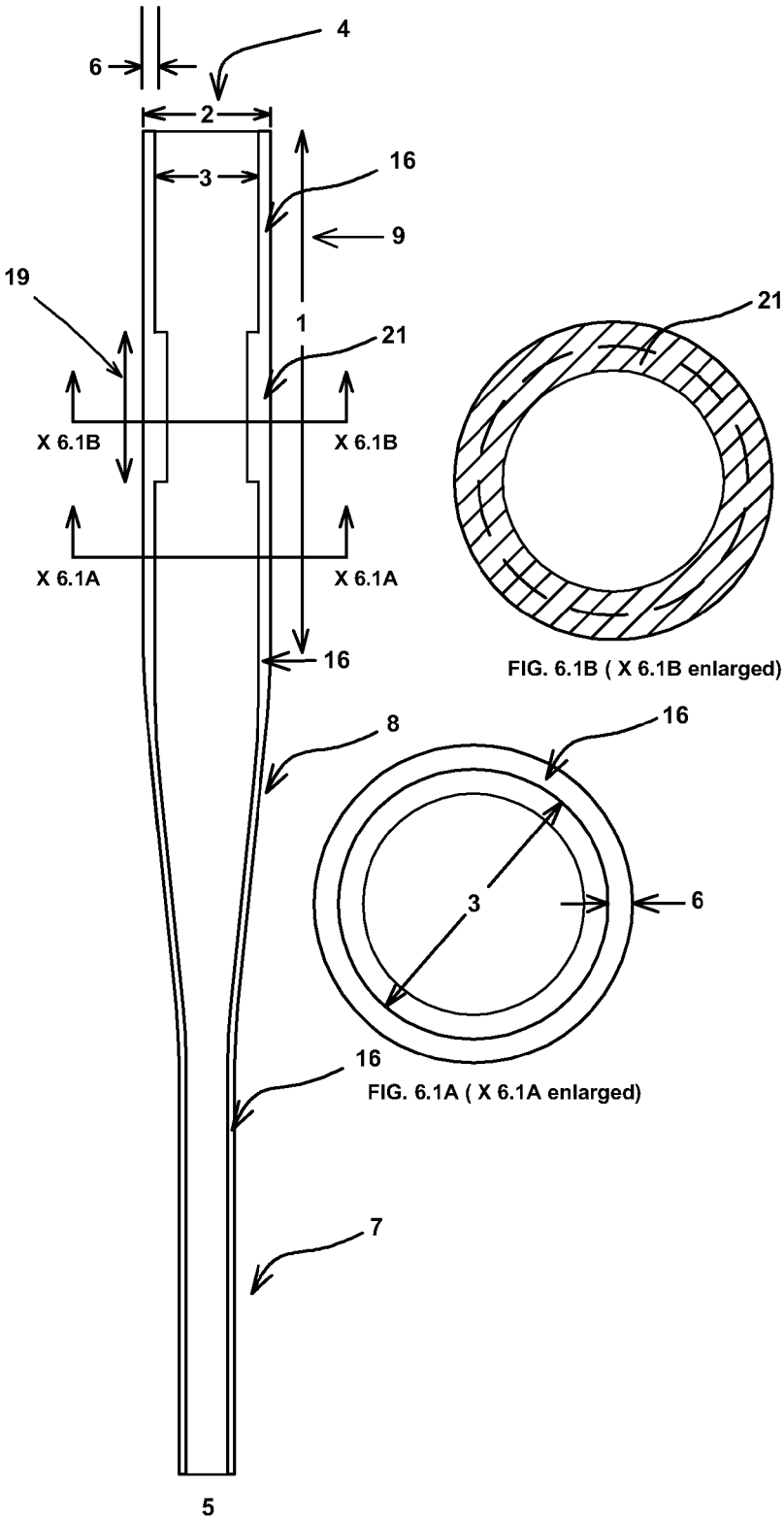
FIG. 6.1

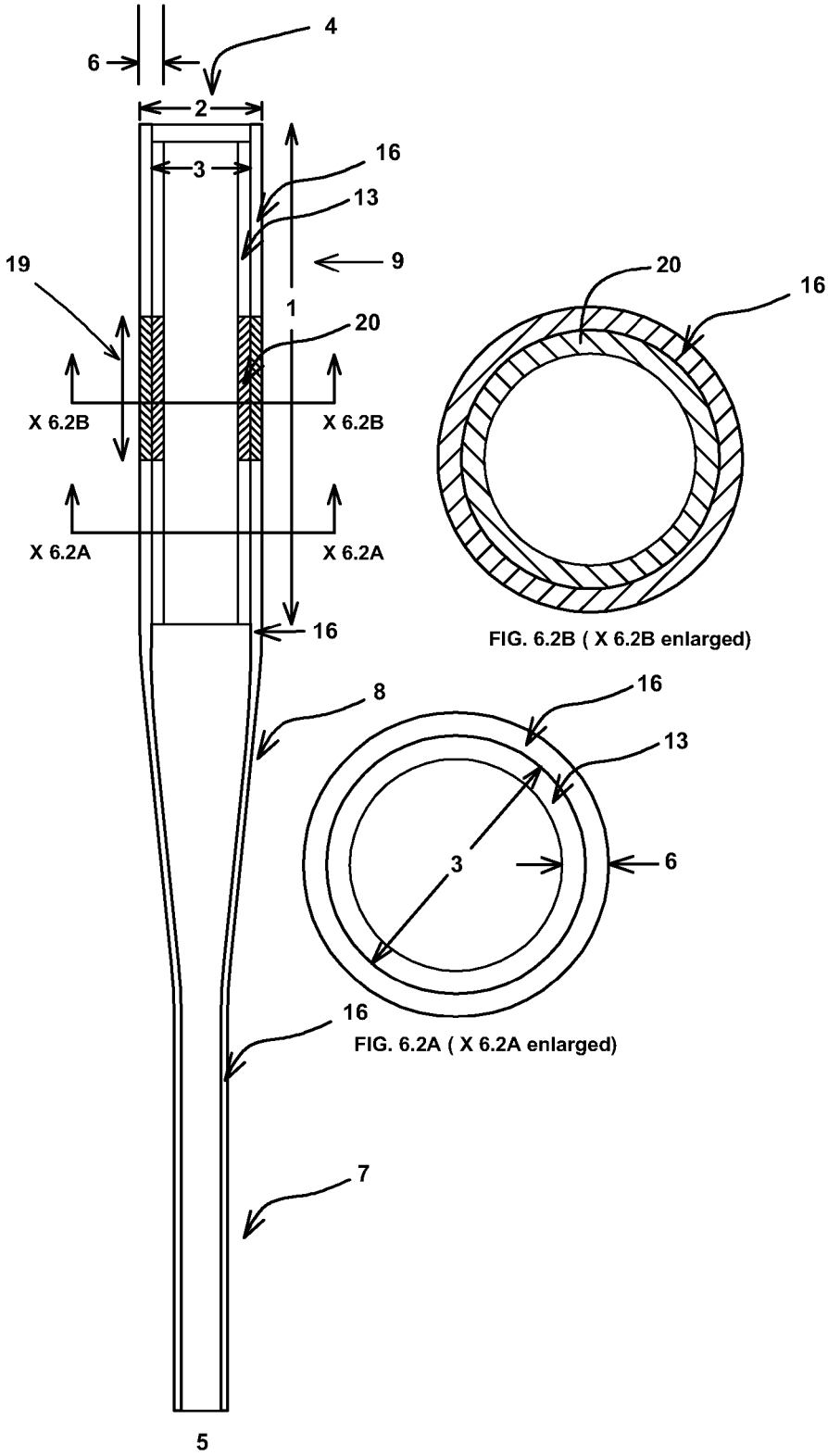
FIG. 6.2

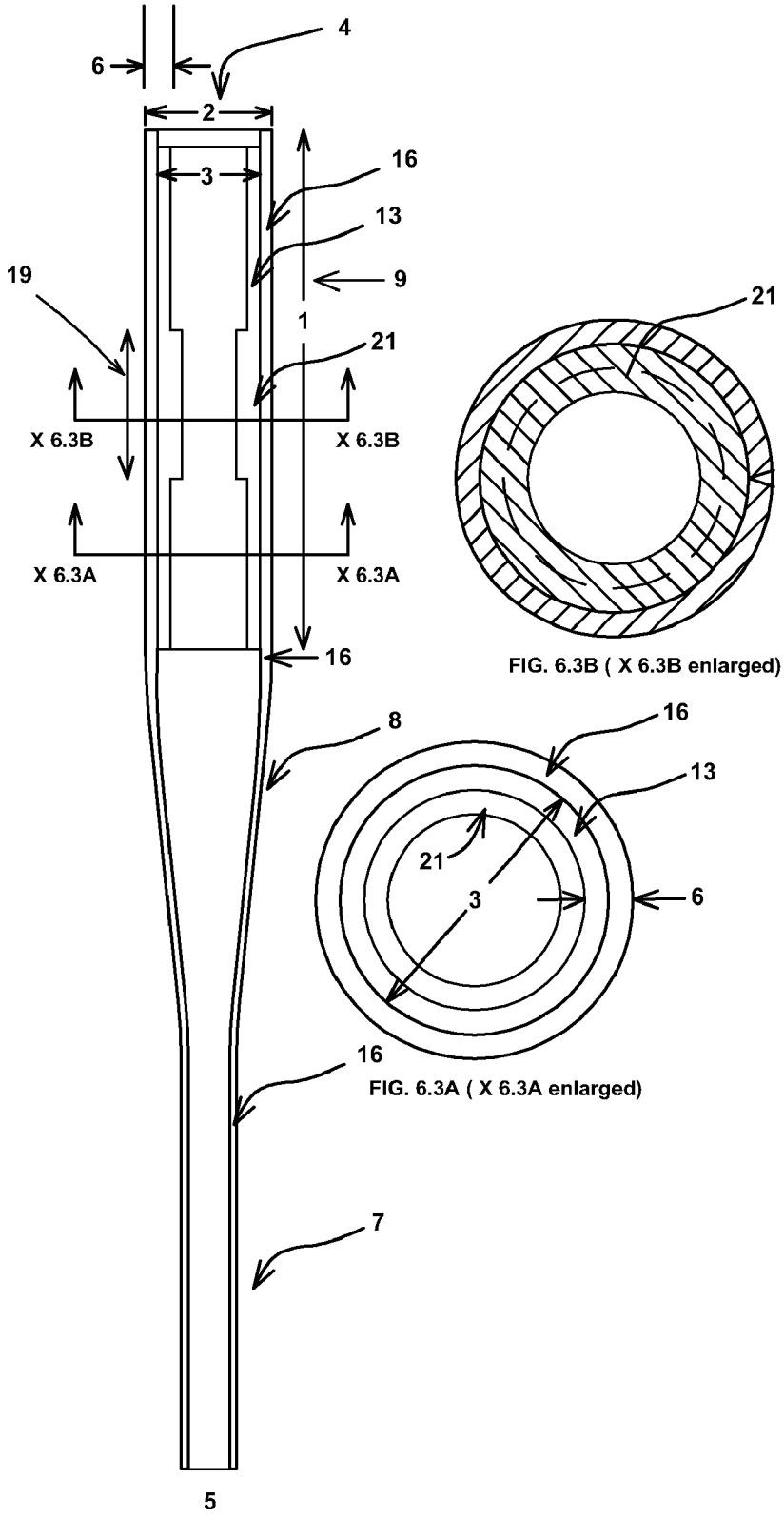
FIG. 6.3

MULTI-WALLED TUBULAR BASEBALL BATS WITH BARREL INSERTS OF VARIABLE GEOMETRY

This application claims the benefit of priority of U.S. Provisional Patent Application 60/745,806, filed 27 Apr. 2006, and is a continuation-in-part of U.S. patent application Ser. No. 10/672,060, filed 29 Sep. 2003.

FIELD OF THE INVENTION

The present invention relates to baseball bats and more particularly to tubular baseball bats, constructed of a variety of materials, and more particularly to baseball bats designed to improve player performance. More particularly, baseball bats according to the invention have variable radial stiffness along the barrel length resulting in larger sweet spots, improved batting performance as defined by greater hitting distance, a vibration soft feel, and unique sounds upon contact with a ball while meeting existing, new, or changed performance standards established by regulatory bodies.

BACKGROUND OF THE INVENTION AND PRIOR ART

Baseball and softball bats, hereinafter referred to simply as "baseball bats" or "bats", are today typically made solely from aluminum alloys, or aluminum alloys in combination with composite materials (hybrid bats), or most recently solely from composite materials (with the exception of solid wooden bats for the Major Leagues). Such bats are tubular (hollow inside) in construction in order to meet the weight requirements of the end user, have a cylindrical handle portion for gripping, a cylindrical barrel portion for hitting, and a tapered mid-section connecting the handle and barrel portions. Traditionally, such bats have generally had a constant radial stiffness along their barrel portion length, measuring the radial stiffness along the barrel wall as independent annular segments of the barrel wall at any location along the barrel wall length.

When aluminum alloys initially replaced wooden bats in most bat categories, the original aluminum bats were formed as a single member, that is, they were made in a unitary manner as a single-walled aluminum tube for the handle, taper, and barrel portions. Such bats are often called single-wall aluminum bats and were known to improve performance relative to wooden bats as defined by increased hit distance. More recently (in the mid 1990's), improvements in bat design largely concentrated on further improving bat performance. This was accomplished primarily by thinning the barrel wall of the single wall bat frame, and adding inner or internal, and or outer or external, secondary members extending along the entire barrel length. These members are often referred to respectively as inserts or sleeves; while the main member is often referred to as a body, shell or frame. Such bats are often called double-wall bats or multi-walled bats in the case of more than two walls resulting from two or more secondary members.

Such double walled and multi-walled tubular bats generally obtained improved performance in terms of hitting distance by reason of the improved elastic deflection that is characteristic of a multilayer barrel wall. The efficient batting of a ball is maximized by minimizing plastic deformation, both within the bat and within the ball. Ideally, during the collision, the barrel wall of the bat should not deform beyond its elastic limit. Use of a multi-wall two or more member construction along the entire barrel length allows the barrel portion of the bat to elastically deflect or flex more upon ball impact which propels the ball faster and further than prior art single wall bats.

The scientific principle governing improved bat performance is bending theory. When a ball impacts a bat it has kinetic energy that must be absorbed by the bat in order to stop the ball. The bat stores most of this energy by flexing. The ball as well deforms. After the ball is stopped, the bat returns the energy it has stored by rebounding and sending the ball back towards where it came from. The more the bat barrel or striking portion deforms upon ball impact without failing (denting or breaking) or experiencing plastic deformation, the lower the energy loss and the greater the energy returned to the ball from the bat as the tubular bat barrel portion impacted returns to its original shape.

To allow the bat barrel portion to deform, requires lowering the radial stiffness of the barrel portion. The prior art double walled and multi-walled tubular bats have traditionally accomplished this by thinning the main member of the barrel portion and adding thin secondary member insert(s) and/or sleeve(s) which are not bonded to the main member, but which generally extend throughout the full length of the barrel portion. Such inserts and sleeves are not coupled to the barrel wall portion of the frame, and these two contacting components may slide with respect to each other in the same manner as leafs within a leaf spring. The resultant lowered radial stiffness along the barrel portion length permits the barrel wall to deflect elastically.

U.S. Pat. No. 5,415,398 to Eggiman is an example of a multiwalled bat that discloses use of a frame and internal insert of constant thickness running full length of the barrel portion of the bat in a double-wall construction.

Other similar bat designs are described in U.S. Pat. No. 5,303,917 to Uke which discloses a two member bat of thermoplastic and composite materials and U.S. Pat. No. 5,364,095 to Easton which discloses a two member bat consisting of an external metal tube and an internal composite sleeve bonded to the inside of the external metal tube and running full length of the barrel portion of the bat.

U.S. Pat. No. 6,251,034 discloses a polymer composite second tubular member running throughout the full length of the barrel portion of the bat with the members joined at the ends only of the barrel portion with the balance of the composite member freely movable relative to the primary member. U.S. Pat. Nos. 6,440,017 and 6,612,945 to Anderson also disclose two member bats with an outer sleeve and inner shell of constant thickness running full length of the barrel portion. Other references include U.S. Pat. No. 6,063,828 to Pitzenberger, U.S. Pat. No. 6,461,760 to Higginbotham; U.S. Pat. No. 6,425,836B1 to Mizuno, and U.S. Patent Pub. 2001/0094882 A1 to Clauzin.

In all the prior art multi-walled tubular bats cited so far, the bat secondary member, or insert, extends along the entire frame barrel length, have constant diameters and thickness resulting in uniform cross-sectional geometry along the secondary member length. Also, the bat members are not joined, except at their ends, in order to reduce radial stiffness of the barrel portion to improve bat performance. Also, in all cases, the radial stiffness of the barrel portion is uniform or constant full length of the barrel portion of the bats.

While the prior art single member, and more particularly, double-walled and multi-walled tubular bats have demonstrated improved performance as claimed, various regulatory bodies have raised safety concerns regarding improved performance bats and thus, some have established maximum performance standards for various categories of baseball bats under their jurisdiction. As a result, manufacturers of baseball bats are required to pass various controlled laboratory tests, such as, bbf (batted ball performance), bbs (batted ball speed), etc. Further, for a given bat category (eg. slowpitch softball), there may be two or more regulatory bodies each of which may establish a different standard. Further, any of the regulatory bodies may change their standard from time to time. Such new or changed or varying regulations are extremely problematic, costly, and disruptive for both manufacturers and players.

It is not generally desirable to lower the performance of a bat by simply increasing the thickness of the barrel wall of one or more of the barrel members along its full length. Lowering the performance of the bat by merely increasing the wall thickness can increase weight such that the finished bat weight standard or objective is exceeded. On the other hand, it is desirable to increase the wall thickness only in the sweetspot, or mid region, of the barrel portion of the bat without significantly increasing the weight.

Therefore, what is needed is a simple, low cost invention to vary, e.g. decrease, bat performance of tubular bats in a controlled manner, in order to meet lowered or changed bat performance standard requirements without significantly increasing or departing from standard bat weight. Further, in conjunction with causing a decrease in batting performance it would be desirable to improve another bat characteristic such as "sweetspot" size.

The sweet spot of a bat is generally the portion of the barrel which, with when struck by the ball, provides maximum batting performance. It is the location on the barrel at which the collision occurs with maximum efficiency and with the transmission of minimum vibration through the handle to the hands of a user. While highly subjective, many players would accept that the sweet spot portion on the bat has a dimension of approximately 2 inches, possibly up to 4 inches, in length and is located generally midway along the barrel portion. It is highly desirable to provide improved bats with a predetermined maximum allowable bat performance and a larger sweetspot region than bats of the prior art. This is one of the primary objectives of the present invention. Further, multi-wall bats of the present invention with inventive secondary members with non-uniform cross-sections along their length provide a vibration free soft feel and produce unique sounds upon contact with a ball.

U.S. published patent application No. 2005/0070384 with patent application filed Sep. 29, 2003, by the inventors of the current application, addresses the larger sweetspot region objective by varying radial stiffness along the barrel length by adding a stiffener, or by changing fibre properties along the barrel length, or by thickening the barrel wall generally in the area of the sweetspot.

U.S. Pat. No. 6,949,038 issued to Fritzke filed Jan. 21, 2004 also addresses this objective. The Fritzke '038 reference purports to achieve an improved sweet spot characteristic by providing a secondary member, located either inside or outside the barrel of a standard frame, wherein the secondary member has a constant outside diameter with an internal wall whose thickness increases while proceeding from its ends inwardly towards the opposing ends. Generally, this thickening is shown to increase to a maximum around the mid-portion of the length of the secondary member. In one figure, FIG. 12, this thickness is shown to partially decrease around the mid-portion of the length of the secondary member, providing two laterally placed regions of maximum thickness on either side of the mid-portion.

While the present inventor's earlier publication and the Fritzke patent represent different means of achieving an enlarged sweet spot of a baseball bat, the present invention includes other means to achieve the same result plus additional benefits regarding performance, feel and sound. Field testing has repeatedly shown that a "soft" feel upon ball impact and/or a "pleasing" sound are both player perceptions which are often favoured by the player over absolute performance as measured by hit distance.

SUMMARY OF THE INVENTION

Therefore, in view of the foregoing, what is needed is a tubular baseball bat with a specific distribution of variable radial stiffness along their barrel portions in order to vary bat performance along the barrel hitting portion length, to make the bat feel "soft" when striking a ball, and to produce a pleasing sound upon impact with the ball. To achieve these objectives, the bats of the present invention are stiffened in the barrel area of peak bat performance commonly referred to as the sweetspot. Typically, this is an area approximately 2" to 4" in width as compared to barrel portion lengths of 4" to 16". This is achieved by the presence of an inventive geometric secondary member, or members, with non-constant outside diameters positioned internally within the bat frame, or by independent numerous annular secondary members located along the inner surface of the barrel portion of an external bat frame, or by inserting or adding to the bat a circumferential stiffener in the region of the sweetspot, or by making the barrel wall thicker in the region of the sweetspot, or by having stiffer material in the region of the sweetspot. Such embodiments also can provide variable bat performance along the barrel length, enlarge the sweetspot size, improve bat performance, have a softer feel upon ball impacts, and produce unique pleasing sounds upon ball impact.

In one embodiment of the present invention, the inventive internal secondary members have a variable outside diameter and constant wall thickness and are characterized by variations in the surface profile on one side of the secondary member wall being reflected by a corresponding profile on the other side of the secondary wall that provide at least two or more contact regions with the internal barrel portion of the frame barrel wall that in turn create at least one functional air cavity that is closed at both ends. In one variant of the invention internal secondary members have constant internal diameters.

In another embodiment of the present invention, two or more independent annular or ring like, members of generally consistent cross-sectional geometry with variable dimensions and with length less than one-half the barrel portion length are internally located in unbonded contact along the inner wall of the barrel portion of an external bat frame. An additional secondary bat member of length approaching the barrel length may be located internally to the annular secondary members.

In another embodiment, a short light weight polymer composite circumferential stiffener of the invention as employed adds only minimal weight to a given bat thus allowing the stiffened bat to continued to be used within the required weight requirements set by the relevant governing body. The stiffener of the present invention can be added to previously constructed tubular bats returned from players for modification to meet a changed regulation allowing such previously manufactured bats to meet a changed standard. Though somewhat heavier, a short metallic stiffener could also be employed. An alternative method of varying stiffness, and thus bat performance, along the barrel portion is to vary thickness along the barrel portion.

Another alternative solution of the present invention for all composite bats is accomplished by engineering calculation considering selection of the composite fiber type, the fibre size, the angles of the fibers, and the thickness of the polymer composite stiffener to be employed to precisely lower the bat performance.

While tubular bats of the present invention have variable radial stiffness along their barrel portions to achieve a specific predetermined bat maximum bat performance, it is simultaneously possible to achieve a sweetspot which is larger than the sweetspot typically found in tubular bats of the prior art. In the present invention this is accomplished by selectively radially stiffening only the peak performance area (generally the sweetspot area) of the bat to provide a radial stiffness therein which is greater than the radial stiffness of the barrel portion area immediately adjacent on both sides of the sweetspot. The resultant effect can be to approximately double the sweetspot size (that is, the area of the barrel portion which provides maximum bat performance). Further, bats of the present invention with secondary members with a variable outside diameter, with or without thickened end portions have a softer feel upon impact and produce unique impact sounds.

The foregoing summarizes the principal features of the invention and some of its optional aspects. The invention may be further understood by the description of the preferred embodiments, in conjunction with the drawings, which follow.

BRIEF DESCRIPTION OF THE DRAWINGS

FIG. 1A shows a cross-sectional area taken at any location through the barrel portion of the FIG. 1 prior art tubular bat.

FIG. 2A shows a cross-sectional area taken at any location through the barrel portion of the FIG. 1 prior art tubular bat.

FIG. 3A shows a cross-sectional area taken at any location through the barrel portion of the FIG. 3 prior art tubular bat.

FIG. 4A shows a cross-sectional area of a barrel location not within the sweetspot area.

FIG. 4B shows a cross-sectional area within the sweetspot area showing the internal stiffener of the present invention.

FIG. 5A shows a cross-sectional area at a barrel location not within the sweetspot area.

FIG. 5B shows a cross-sectional area within the sweetspot area showing an external stiffener of the present invention.

FIG. 6A shows a cross-sectional area at a barrel location not within the sweetspot area.

FIG. 6B shows a cross-sectional area within the sweetspot area showing a stiffened area of changed fiber angles and/or type.

FIG. 6.1 shows a longitudinal cross section of a single wall polymer composite tubular bat in accordance with the present invention showing the alternative construction incorporating a thickened barrel wall 21 resulting in increased radial stiffness generally confined to the sweetspot area of the barrel portion.

FIG. 6.1A shows a cross-sectional area at a barrel location not within the sweetspot area.

FIG. 6.1B shows a cross-sectional area within the sweetspot area showing a stiffened area with thicker barrel wall.

FIG. 6.2 shows a longitudinal cross-section of an alternative double wall polymer composite bat in accordance with the present invention showing a localized area of the fibre type and/or fibre angle change within the insert resulting in increased radial stiffness generally confined to the sweetspot area of the barrel portion.

FIG. 6.2A shows a cross-sectional area at a barrel location not within the sweetspot area.

FIG. 6.2B shows a cross-sectional area within the sweetspot area showing a stiffened area of changed fibre angles and/or type.

FIG. 6.3 shows a longitudinal cross-section of a double wall polymer composite bat in accordance with the present invention with an alternative construction showing a thickened barrel wall 21 within the insert resulting in increased radial stiffness generally confirmed to the sweetspot areas of the barrel portion.

FIG. 6.3A shows a cross-sectional area of a barrel location not within the sweetspot area.

FIG. 6.3B shows a cross-sectional area within the sweetspot area showing a stiffened area with thicker barrel wall.

FIG. 7A shows a cross-sectional area at a barrel location not within the sweetspot area.

FIG. 7B shows a cross-sectional area within the sweetspot area showing the internal stiffener.

FIG. 8A shows a cross-sectional area at a barrel location not within the sweetspot area.

FIG. 8B shows a cross-sectional area within the sweetspot area showing the external stiffener.

DETAILED DESCRIPTION OF THE INVENTION

The present invention is directed to providing tubular baseball bats with variable radial stiffness along the length of the barrel or hitting portion 1, of the bats. Bats of the present invention can have a larger sweetspot size 19, have a soft feel with substantially reduced vibrations, and produce unique pleasing sounds upon impact with a baseball or softball. Further, such bats can be produced at reasonably low costs.

Unless otherwise indicated, the term stiffness as used in this disclosure is equivalent to the modulus of elasticity and is a measure of the change in length of a material under loading. For a tubular body, such as a baseball bat, stiffness of the material can be measured in the axial direction, parallel to the longitudinal axis of the tube, or the radial or transverse direction perpendicular to the longitudinal axis of the tube. Radial stiffness is a measure of the force required to depress any given a section of the tube in the radial direction. Radial stiffness is a function of modulus of the material, the tube thickness and the tube diameter. Radial stiffness is measured along the barrel wall as independent annular segments of the barrel wall at each measurement location.

Figure 1:
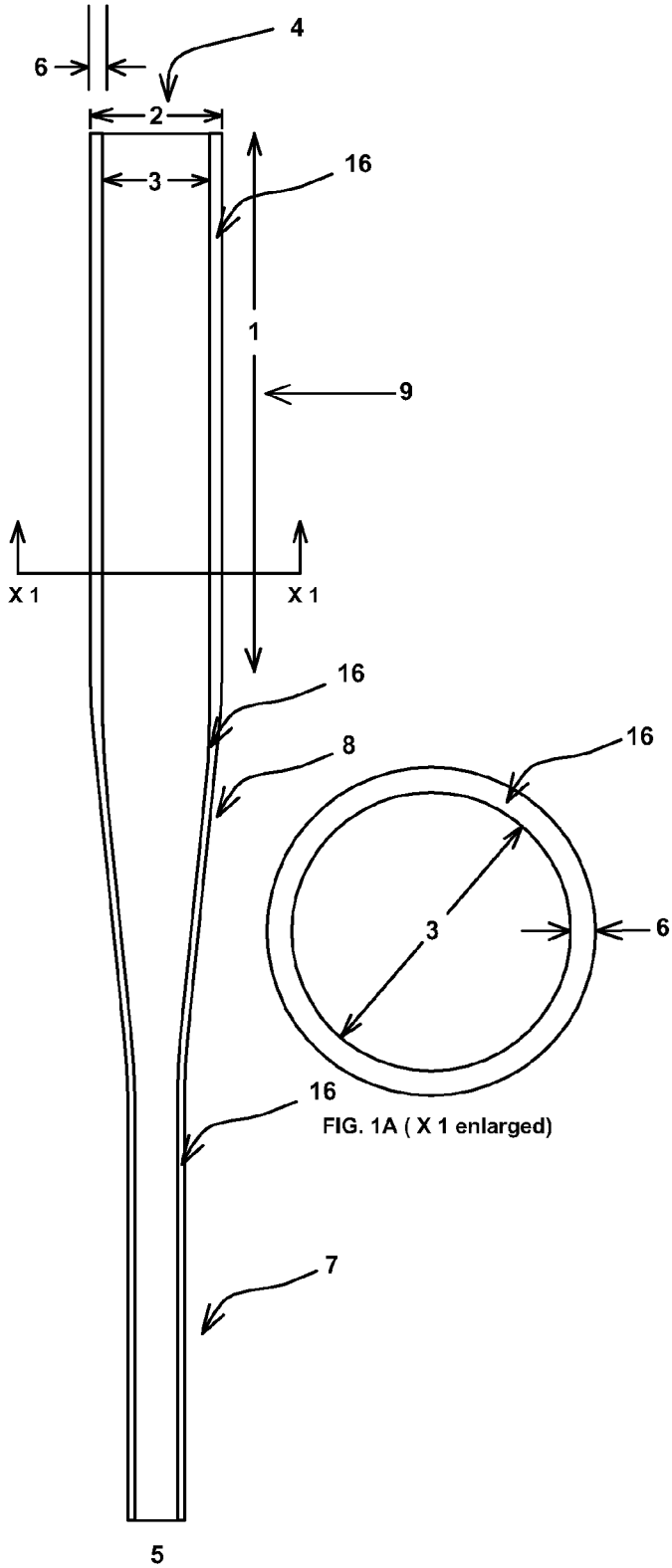
FIG. 1 (PRIOR ART)
FIG. 1 shows a longitudinal cross-section of a typical prior art single wall tubular bat with a singular frame, or member, construction.
Figure 2:
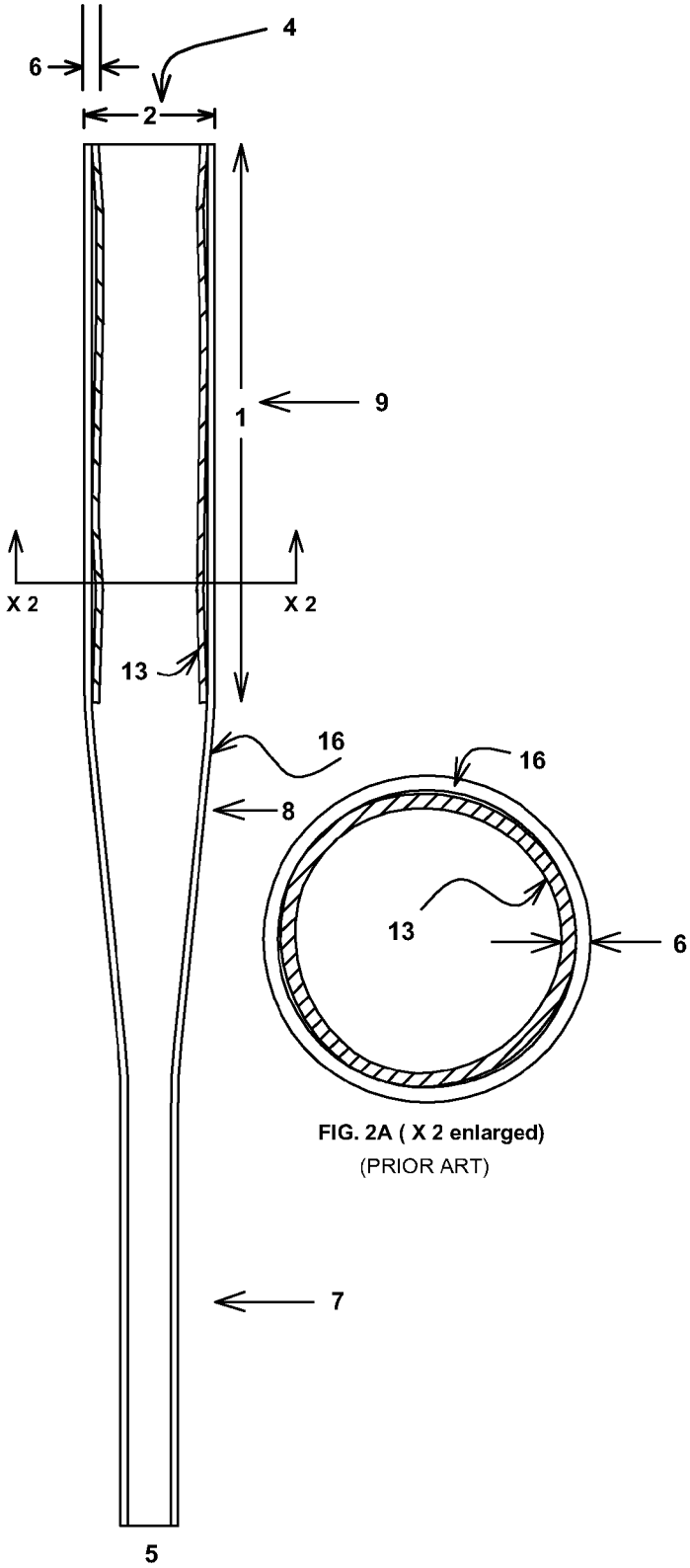
(PRIOR ART) FIG. 2 (PRIOR ART)
FIG. 2 shows a longitudinal cross-section of a typical prior art double-wall tubular bat with two separate members, a frame or main member with an internal insert as a secondary member in the barrel area. Both the frame and insert run the full length of the barrel portion and are not joined full length.
Figure 3:
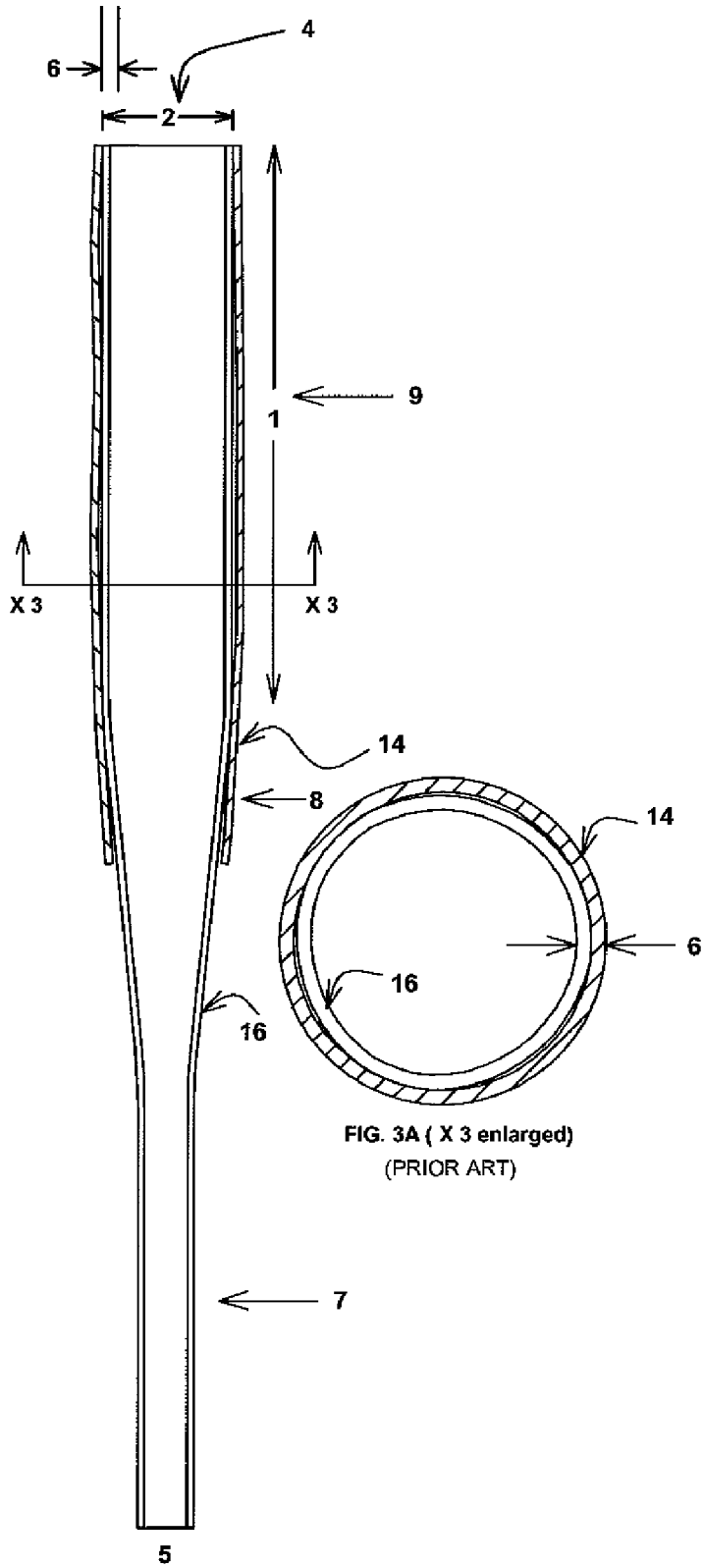
(PRIOR ART) FIG. 3 (PRIOR ART)
FIG. 3 shows a longitudinal cross-section of a typical prior art double-wall tubular bat with two separate members, a frame or main member with an external sleeve secondary member in the barrel portion. Both the frame and sleeve run the full length of the barrel portion and are not joined full length.

The prior art bats are shown in FIGS. 1, 2, 3, and 11. FIGS. 1 and 11A show a single wall tubular bat with main member or frame 16. FIGS. 2 and 11C show a double wall tubular bat with an insert or primary secondary member 13, formed separately from the main member 16, which is fitted into the entire barrel length 1 of the main member 16. FIG. 3 shows a double wall tubular bat with a sleeve 14, formed separately from the main member 16, which is fitted over the entire barrel length 1 of the main member 16. FIG. 11B shows a single wall tubular bat with the main member 16 being internally thickened in the barrel mid-section. FIGS. 11D and 11E show double wall tubular bats with an internally thickened secondary member 13 and in the case of FIG. 11E also an internally thickened main member 16.

Though not indicated in FIGS. 1 through 8, and 11 through 14, bats of the present invention, similarly to bats of the prior art, include a traditional knob at the handle portion end 5, or proximal end of the bat, and a traditional end cap 21 (not shown in FIGS. 1 through 8) at the barrel portion end 4, the distal end, both of which can be made from a variety of materials.

Most adult tubular baseball bats of the prior art have maximum outside barrel portion diameter 2 of either 2.625 inches or 2.75 inches. Depending on the taper portion geometry of the mid-section 8, and the total length of the bat, the barrel length 1 as defined by length of constant maximum diameter 2, ranges from 4 to 12 inches. Total barrel wall thickness 6 ranges from 0.100 inches to 0.140 inches for aluminum bats and up to 0.220 inches for all composite bats and is measured at any point along the barrel wall as the outside diameter of the frame or member with the largest outside diameter minus the inside diameter of the member with the smallest outside diameter including any gaps, or spaces, between the two extreme diameters.

Most youth baseball bats and softball bats of the prior art have maximum outside barrel portion diameter 2 of 2.25 inches. Depending on the taper portion geometry of the mid-section 8, the barrel length 1 ranges from 4 to 16 inches. Barrel wall thickness 6 ranges from 0.060 inches to 0.090 inches for aluminum bats and up to 0.220 inches for all composite bats.

The bats of the present invention, shown in FIGS. 4 through 8, and 12 through 14, have similar dimensions to the foregoing prior art bats shown in FIGS. 1, 2, 3, and 11.

Figure 4:
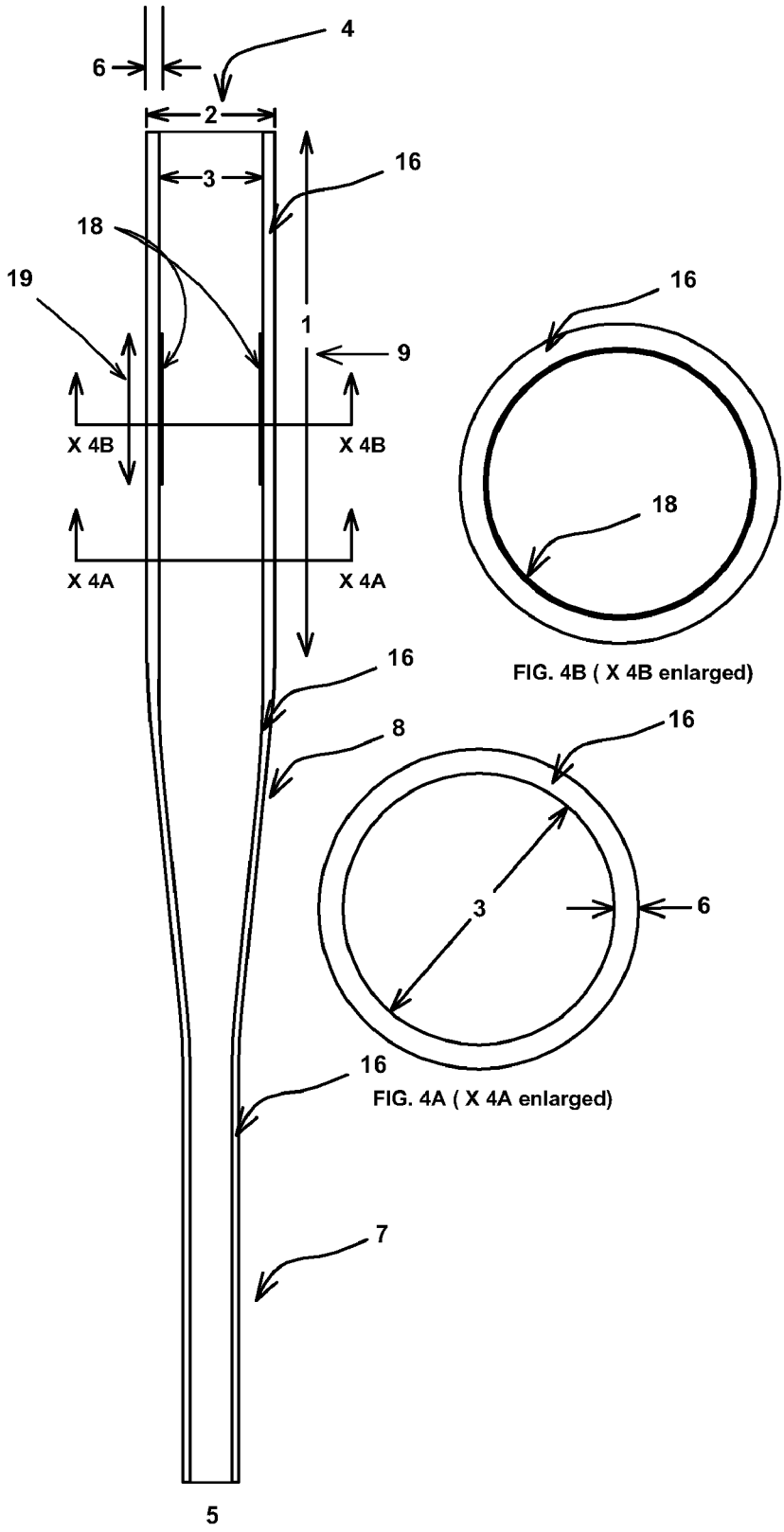
FIG. 4 shows a longitudinal cross-section of one embodiment of the present invention showing a single wall tubular bat in accordance with the present invention showing an internal stiffener generally confined to the sweetspot area of the barrel portion and joined to the barrel portion.

A first embodiment of the present invention FIG. 4 is a single wall tubular baseball bat consisting of a cylindrical handle portion 7 for gripping, a cylindrical tubular barrel portion 9 for striking or hitting, and a tapered portion 8 connecting the handle 7 and barrel 9 portions, with a thin polymer composite stiffener 18 having a stiffener wall located internally within the barrel portion 9 and extending longitudinally in the mid-section, sweetspot area 19 of the barrel length 1.

A polymer composite is a non-homogenous material consisting of continuous fibers embedded in, and wetted by, a polymeric resin matrix whereby the properties of the material are superior to those of its constituent fibers and resin taken separately. Such polymer composites are anistropic materials since they exhibit different responses to stresses applied in different directions depending on how the fibers are aligned or angled within the matrix.

Other materials commonly used in bat constructions such as aluminum, wood and plastics are not anistropic and are thus limited in controlling bat performance; for example, radial stiffness is equal to longitudinal stiffness and cannot be graduated along the barrel length 1. However, with composite materials, which are preferred, properties of bats made in accordance with the present invention, such as radial stiffness which determines bat performance can be controlled (i.e. designed to a given requirement) by altering such parameters as the fiber alignments along the barrel length 1, and/or the type of fibers chosen, their demier or layout density and/or the thickness of the polymer composite structure.

Generally, the fiber materials used are selected from a group consisting of fiberglass, graphite or carbon, aramid, boron, nylon, or hybrids of any of the foregoing, all of which are commercially available. The resins used to impregnate, wet out, and encapsulate or imbed the fiber materials are generally selected from a group consisting of epoxy, polyester, vinyl ester, urethane, or a thermoplastic such as nylon, or mixtures thereof.

The first embodiment of the present invention, depicted in FIG. 4, consists of a thin polymer composite stiffener 18 located internally within the barrel portion 9 generally in the sweetspot area 19 located in proximity to the middle or mid-section area of the barrel length 1 of a single wall tubular bat. The resultant stiffened bat results in a predetermined calculated lower performance, with an enlarged sweetspot 19, as subsequently explained.

The sweetspot area 19 of a baseball bat is generally referred to as that area along the barrel length 1 in which bat performance is greatest; that is, a ball struck within the sweetspot area 19 will travel further than a ball struck on either side of the sweetspot area. Typically, the sweetspot area 19 is located around the middle of the barrel length 1 and is in the order of about 2 inches to 4 inches in length when compared to overall barrel lengths 1 which range from approximately 4 inches to 16 inches or more.

Figure 9:
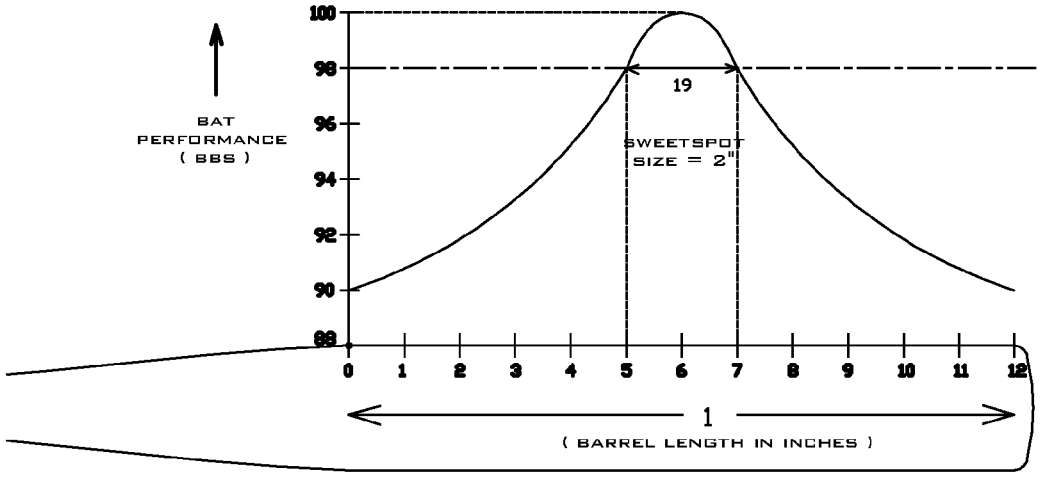
FIG. 9 shows in graphical form the typical relationship between tubular bat performance and barrel location and sweetspot size.

In actual practice, the performance of a baseball bat of the prior art follows a statistical normal distribution along the barrel length 1, usually centered near the middle of the barrel length 1 in the sweetspot area 19. FIG. 9 shows a typical bat performance distribution example with a 12-inch barrel length 1.

In FIG. 9, the maximum bbs (one measure of bat performance standard) is 100 while most players would describe the sweetspot as being approximately 2 inch long (that is, the portion of the barrel length equal to or greater than 98 bbs). The bat of this particular sample meets a bat performance factor standard of 100 bbs maximum if so regulated.

Figure 10:
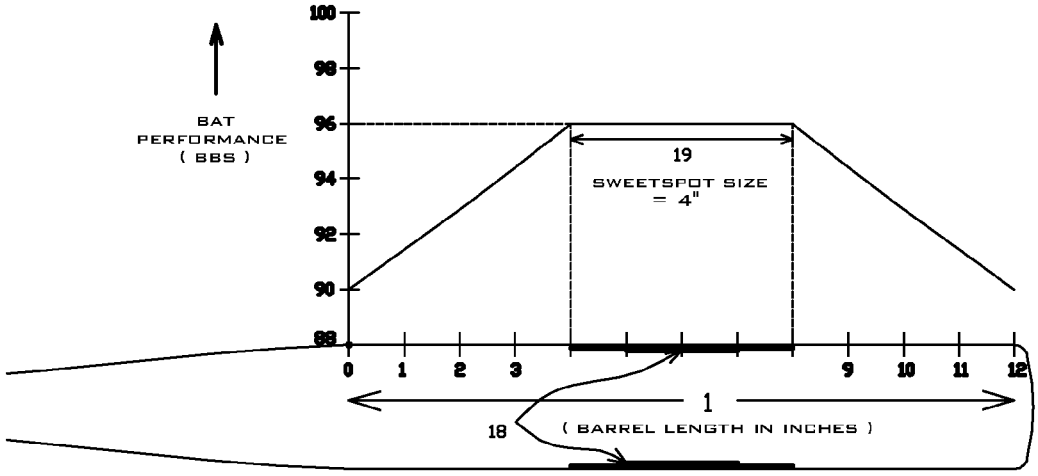
FIG. 10 shows in graphical form a typical relationship between tubular bat performance of a bat of the present invention and barrel location and sweetspot size.
Figure 11A:
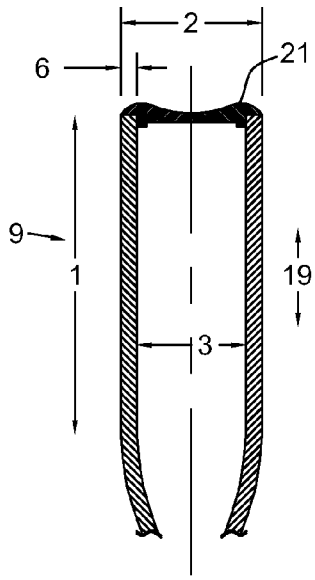
FIG. 11A (PRIOR ART)
FIG. 11A shows a longitudinal cross-section of the barrel portion of a typical prior art single wall tubular bat with a singular frame, or main member. Not shown in FIG. 11A and all following figures is the traditional bat handle portion located at the proximal end of the taper portion.
Figure 11B:
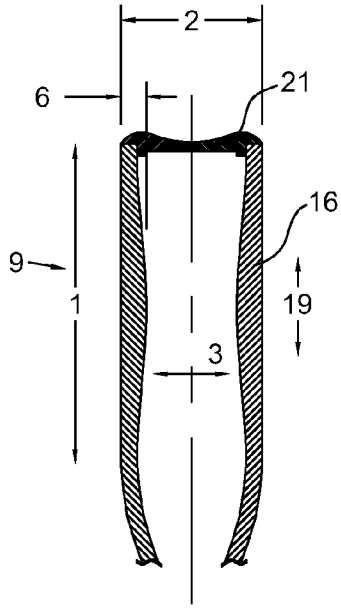
FIG. 11B (PRIOR ART)
FIG. 11B shows a longitudinal cross-section of the barrel portion of a typical prior art single wall tubular bat with a singular frame, or main member, construction wherein the barrel wall is inwardly thickened generally in the area of the sweetspot.
Figure 11C:
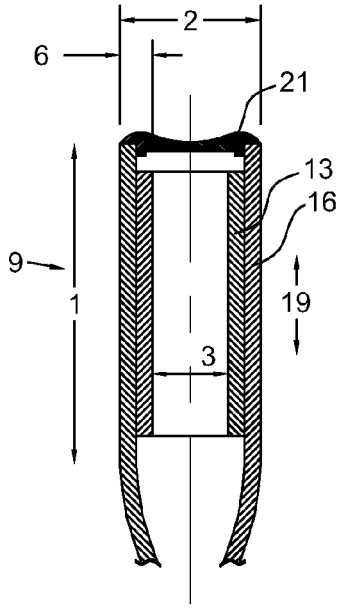
FIG. 11C (PRIOR ART)
FIG. 11C shows a longitudinal cross-section of the barrel portion of a typical prior art double wall tubular bat with an external frame and a secondary internal member, or insert.
Figure 11D:
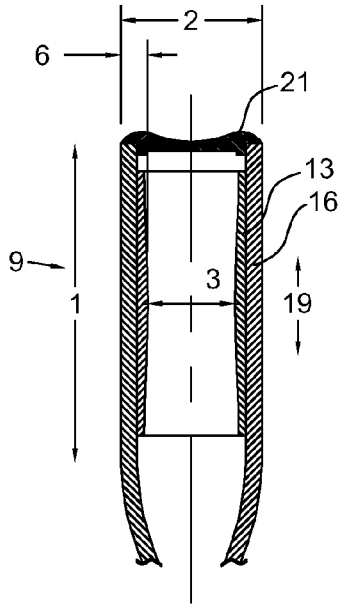
FIG. 11D (PRIOR ART)
FIG. 11D shows a longitudinal cross-section of the barrel portion of a typical prior art double wall tubular bat with an external frame and a secondary internal member, or insert, wherein the insert is inwardly thickened generally in the area of the sweetspot.
Figure 11E:
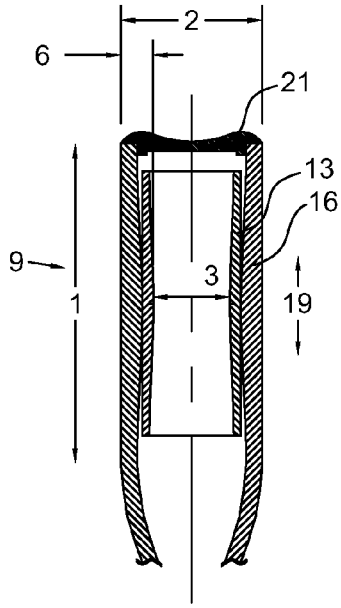
FIG. 11E (PRIOR ART)
FIG. 11E shows a longitudinal cross-section of the barrel portion of a typical prior art double wall tubular bat with an external frame and a secondary internal member, or insert, wherein both the frame and the insert are inwardly thickened generally in the area of the sweetspot.

If the applicable regulatory body for the bat in the FIG. 9 example changed the bat performance standard from 100 bbs maximum to say 96 bbs maximum, the bat of the present invention could be provided with a specifically designed 4 inch polymer composite stiffener 18 located in the center of the barrel length 1. FIG. 10 shows the bbs versus barrel length for this example.

In FIG. 10, in an example of the present invention, the combined barrel wall, with the polymer composite stiffener 18 present, is approximately twice as stiff in the center 2 inches of the sweetspot area 19 as in the 1 inch area immediately adjacent to the center or mid-section area on each side of the center area. The polymer composite stiffener 18 fiber type, fiber angles and thicknesses are designed such as to reduce the bbs from 100 to 96 in the center 2 inch area of the barrel length 1 and from 98 to 96 bbs in the 1 inch areas immediately adjacent to the center area. As a result of the present invention, the resultant typical example bat meets the lowered regulatory standard of 96 bbs with a sweetspot area 19 which has been increased in size by 100% (from 2 inches wide to 4 inches wide). At the same time the regions around points A and B have been introduced into the batting performance curve of FIG. 10 that were not present in the curve of FIG. 9, with the more flattened portion there-between that is characteristic of an enlarged sweet spot.

Alternatively, thickening the total barrel wall with the same material, the same thickness, and the same location as the stiffener results in the identical reduced bat performance.

The first embodiment (i.e. as shown in FIG. 4) of the present invention is particularly suited to retrofitting used bats returned by players and making them legally playable under a revised standard.

The thin polymer composite stiffener 18 of the present invention has a stiffener wall which is typically in the order of 0.010 inches to 0.040 inches in thickness, preferably 0.020" with a length of 2 inches to 6 inches which is typically less than 50% of the barrel length, such as 16⅔% of the barrel length, as is apparent from FIG. 10. A 4 inch stiffener, in a 12 inch barrel as referenced in FIG. 10, would represent 33.3% of the barrel length; a 4 inch stiffener in a 16 inch barrel would represent 25%, and a 2 inch stiffener in a 16 inch barrel would represent 12.5% of the barrel length. The stiffener 18 is preferably bonded, fully or partially, to the main member 16, or to the secondary member insert 13 of FIG. 7 or to the secondary member sleeve 14 of FIG. 8, or combinations thereof on either the internal or external barrel walls, as shown in FIGS. 4, 5, 7 and 8. Analogous to FIGS. 4, 5, 7 and 8 an alternative solution (since stiffness is proportional to thickness) to the stiffener 18 is to vary the barrel thickness 6 to the same extent and manner along any portion of the barrel length 1 of any bat according to the invention, including the bat of FIG. 6 in order to vary bat performance. The barrel portion's effective wall thickness in the mid-section can be greater by 8⅓% or more over the thickness of the barrel in the lateral, adjacent portions. Conversely, the barrel wall's thickness beyond its central portion, in the lateral regions proceeding towards the end portions of the barrel, may be at least 8⅓% thinner than the thickness of the barrel wall in the mid-section. Just as the stiffener wall may be typically in the order of 0.005 inches to 0.040 inches in thickness, or 0.010 inches to 0.040 inches in thickness, or 0.015 inches to 0.040 inches in thickness, or 0.015 inches to 0.030 inches, so too the analogous increase in barrel wall thickness along the mid-section may fall within the same ranges.

Figure 5:
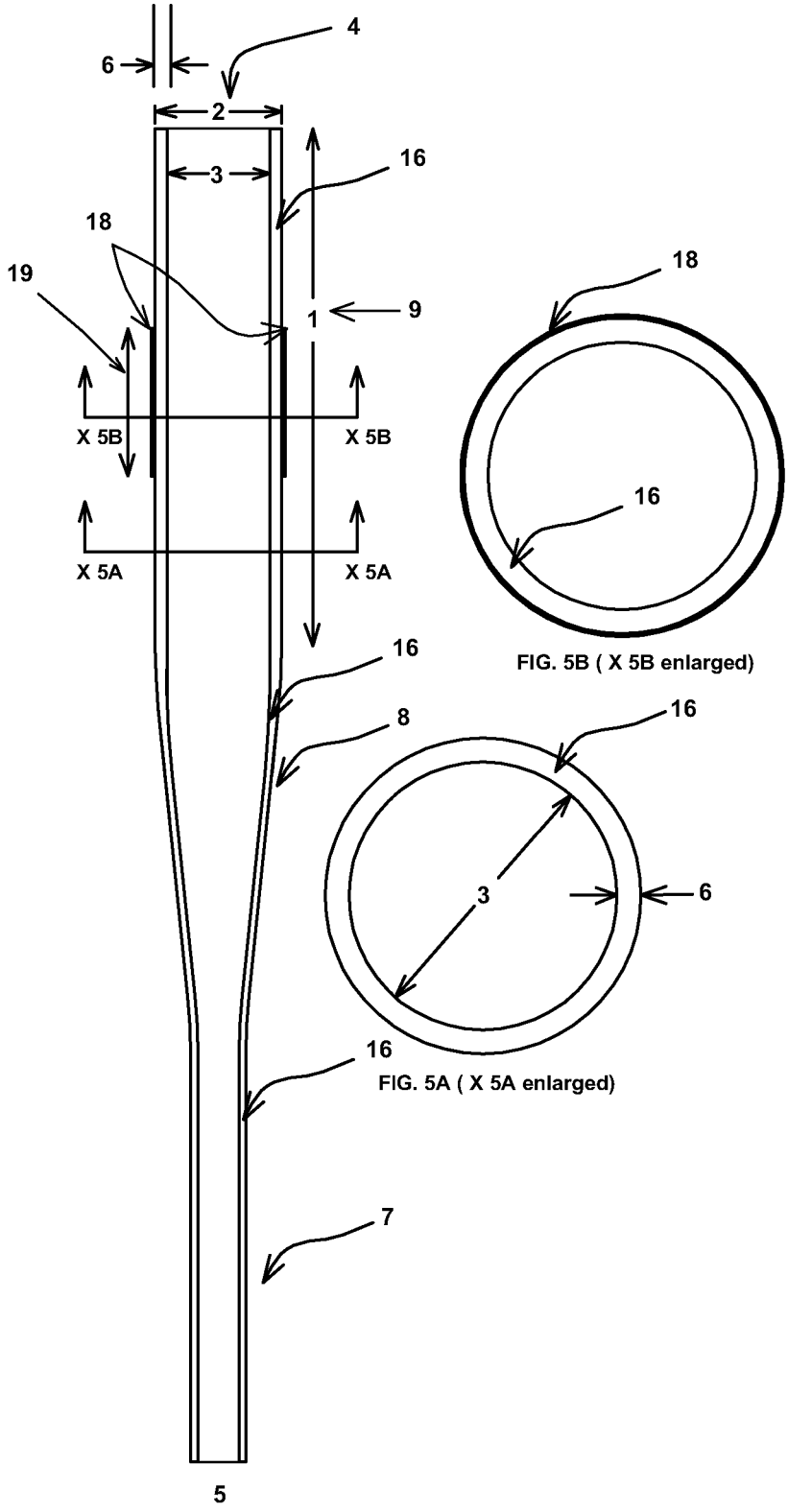
FIG. 5 shows a longitudinal cross-section of a second embodiment of the present invention showing a single wall tubular bat in accordance with the present invention with an external stiffener generally confined to the sweetspot area of the barrel portion and joined to the barrel portion.

A second embodiment of the present invention, as shown in FIG. 5, is a single wall tubular baseball bat which in accordance with the present invention has a thin polymer composite stiffener 18 located externally to the barrel portion 9 generally in the sweetspot area 19 located in proximity to the middle area of the barrel length 1. The resultant stiffened bat results in a calculated lower performance, with a bigger (longer) sweetspot 19, as previously explained.

Figure 6:
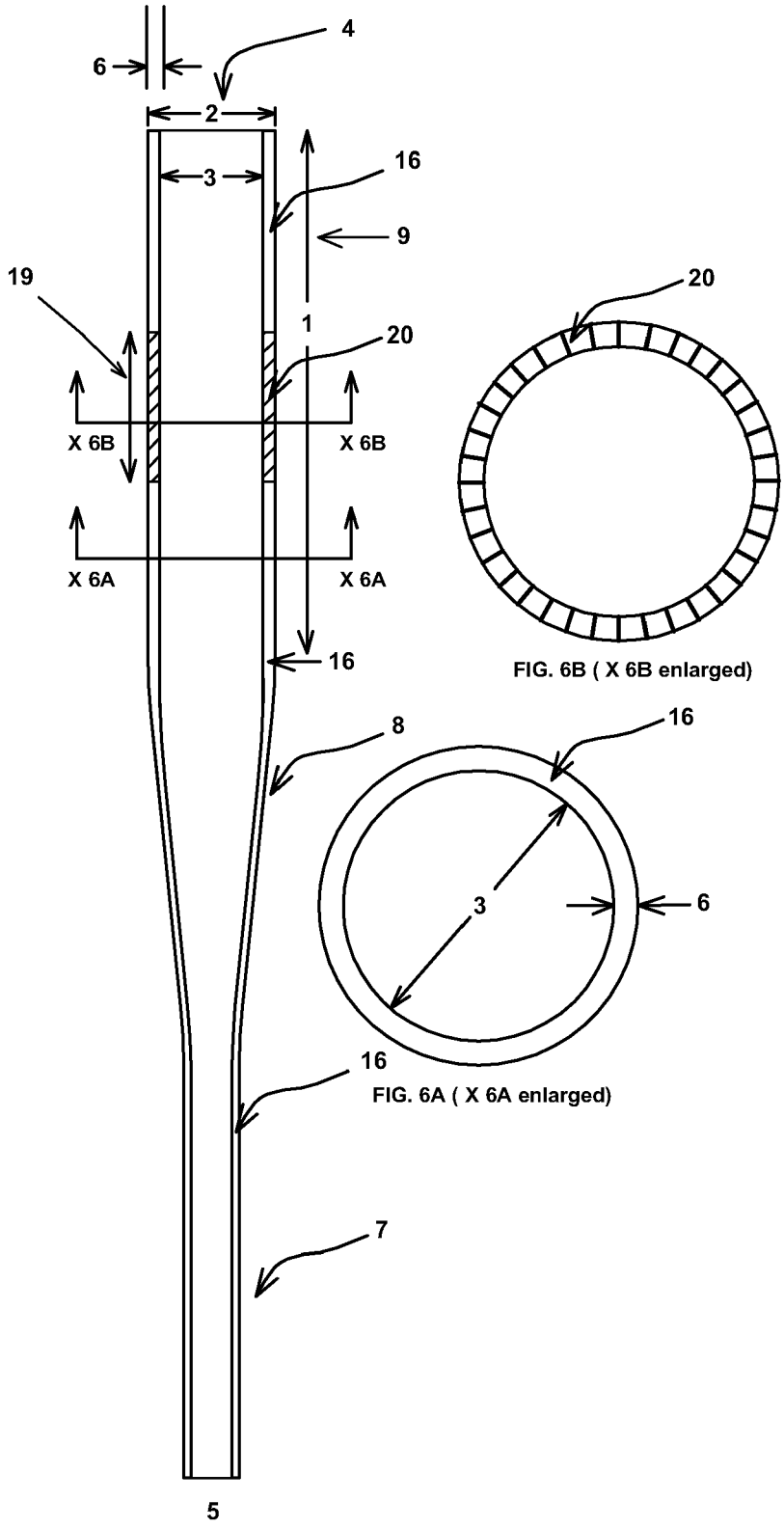
FIG. 6 shows a longitudinal cross-section of a third embodiment of the present invention showing a single wall polymer composite tubular bat in accordance with the present invention showing a localized area of the fiber type and/or angle change resulting in increased radial stiffness generally confined to the sweetspot area of the barrel portion.

A third embodiment of the present invention, as shown in FIG. 6, is a single wall tubular polymer composite baseball bat which in accordance with the present invention has a localized area of fiber type of greater stiffness and/or angle change 20 resulting in increased radial stiffness generally in the sweetspot area 19 located in proximity to the middle area of the barrel length 1. This embodiment applies equally well to double-wall and multi-wall (more than two walls) tubular all polymer composite baseball bats and is limited to newly designed polymer composite single wall, double-wall, and multi-walled new bats as opposed to field returned bats. The fiber types, and/or fiber angles, and/or fiber sizes, and/or composite thickness can be designed such as to graduate the radial stiffness of the barrel wall within the barrel portion 1 along its entire length. That is, the radial stiffness could be higher in the peak performance area (generally the sweetspot area 19) than in the lateral regions immediately adjacent to the sweetspot area 19. In fact, by duplicating the increase in radial stiffness in the barrel mid-section as achieved by the stiffener 18 of FIG. 4 or 7, the exact same bat performance change as shown in FIG. 10 and enlarged in sweetspot size 19 can be achieved by bats of FIG. 6. Similarly, the alternative solution FIG. 6.1 showing a single wall tubular bat with a thickened barrel wall 21 and the alternative solution FIG. 6.3 showing a double wall tubular bat with a thickened barrel wall 21, with the same material, location, and thickness of the stiffener 18 will result in the same bat performance change, as shown in FIG. 10, and resultant enlarged sweetspot size 19.

Figure 7:
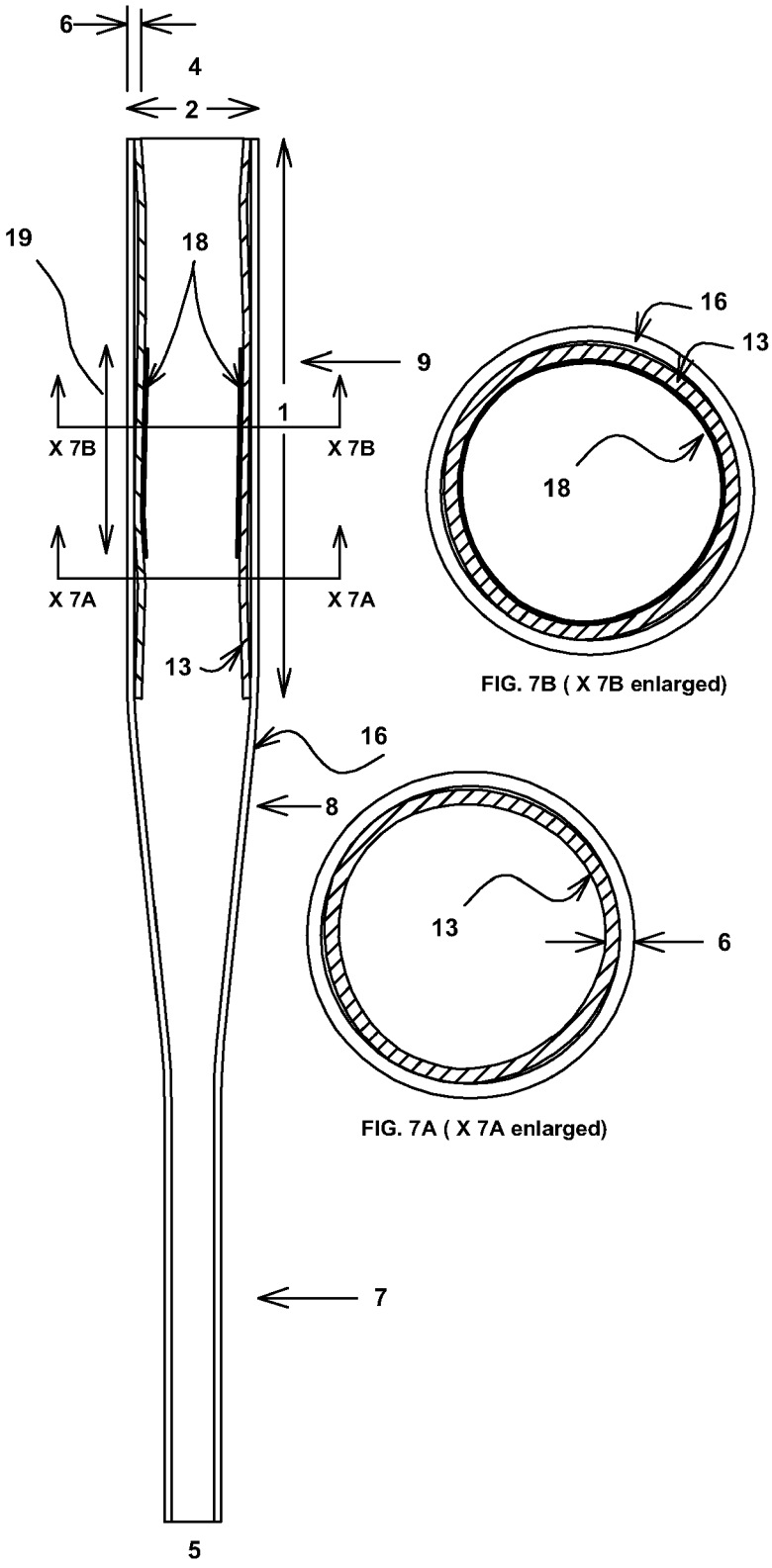
FIG. 7 shows a longitudinal cross-section of a fourth embodiment of the present invention showing a double-wall tubular bat with two separate members, a frame or main member with an internal insert as a secondary member full length in the barrel portion, and in accordance with the present invention, showing an internal stiffener generally confined to the sweetspot area of the barrel portion and joined to the barrel portion.

A fourth embodiment of the present invention, as shown in FIG. 7, is a double-wall tubular bat showing two separate members, a frame or main member 16 with an internal insert 13 as a secondary member full length in the barrel length 1 and, in accordance with the present invention, a stiffener 18 located internally within the insert 13 generally confined to the sweetspot area 19, along the barrel length 1. Though not shown, the stiffener 18 could be located externally to the main member 16 or between the main member 16 and the internal insert 13. Also, though not shown, in multi-walled bats the stiffener 18 could be located internally, or externally, or between the members, or combinations thereof.

Figure 8:
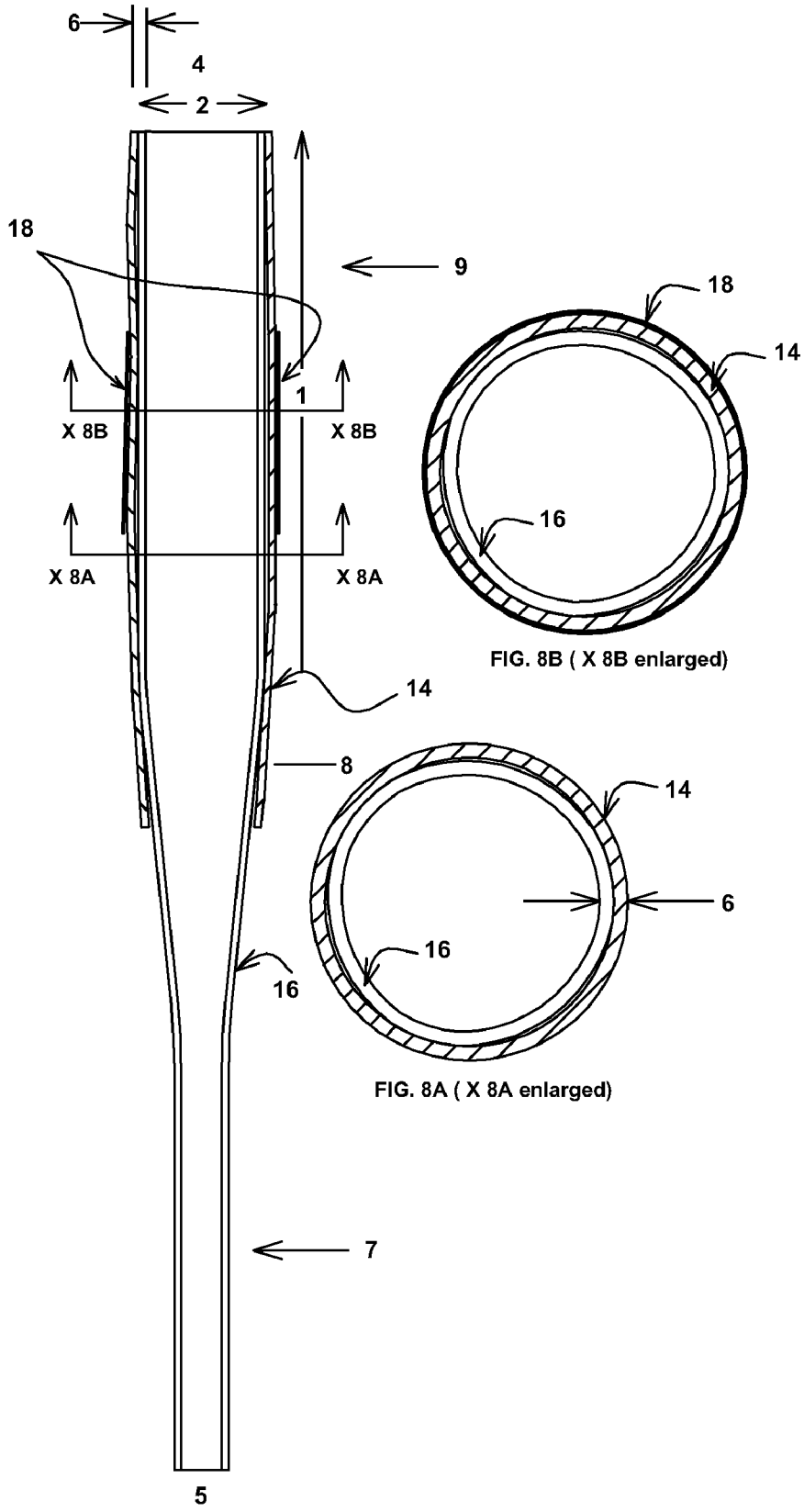
FIG. 8 shows a longitudinal cross-section of a fifth embodiment of the present invention showing a double-wall tubular bat with two separate members, a frame or main member with an external sleeve as a secondary member full length in the barrel portion, and in accordance with the present invention showing an external stiffener generally confined to the sweetspot area of the barrel portion and joined to the barrel portion.

A fifth embodiment of the present invention, as shown in FIG. 8, is a double-wall tubular bat showing two separate members, a frame or main member 16 with an external sleeve 14 as a secondary member full length in the barrel length 1 and, in accordance with the present invention, a stiffener 18, located externally to the sleeve 14, generally in the area of the sweetspot area 19 along the barrel length 1. Though not shown, the stiffener 18 could be located internally to the main member 16 and the external sleeve 14. Also, though not shown, in multi-walled bats, the stiffener 18 could be located internally, or externally, or between the members, or combinations thereof.

All embodiments of the present invention, as shown in FIGS. 4, 5, 6, 7, 8, 12C, 12I, 13A, 13B, 13C, 13D, and 13F, exhibit greater radial stiffness in the mid-section of the barrel length 1 relative to the lateral regions immediately adjacent to the mid-section, resulting in an enlarged sweetspot area 19.

Besides an enlarged sweetspot, other objectives of bats of the present invention include providing a user with a "soft feel", having substantially less vibrations transmitted to the user's hand while striking a ball, unique impact sounds, and higher performance for average or below average players when making contact away from the normal sweetspot. These further objectives are achieved by bats of the present invention with secondary members with a variable outside diameter and by bats with two or more independent annular secondary members internally located along the inside diameter of the external bat frame.

All bats of the present invention shown in FIG. 12 are characterized by inventive primary secondary members, or inserts 13, located internally within an external main member, or frame 16, with frame wall thickness 44, within the barrel length 1 of the hitting portion of the bat. The primary secondary member 13 has an inner surface 53, an outer surface 55, an inner diameter 29, an outer diameter 25, a wall thickness 27, a length 26, a proximal end 58, and a distal end 59. Not shown in the FIGS. 12 and 13 bats is the normal handle portion located adjacent to the taper proximal portion and knob located at the proximal end of the frame 16 traditional bats. A traditional endcap 21 encloses the distal end 49 of the barrel portion 9. The inventive primary secondary members 13 of the bats of FIG. 12 have outer diameters 25 that vary along the majority of the barrel length 1. The variations in outer diameter 25 of the inserts 13 in all bats of FIGS. 12 are dimensioned to produce two or more contact areas 30 with the inside surface 45 of the frame 16. In some variants of the bats of FIG. 12, the primary secondary member 13 contact areas 30 have substantially flattened portions of constant maximum outer diameter, while in others the contact portions are much smaller. The contact areas 30 create at least one enclosed air cavity 22 with a maximum air cavity thickness 23 of at least 0.010". The air cavities 22 of the present invention are closed at both ends to produce the desired feel and sound objectives upon ball contact. Varying positioning and quantities of the air cavities 22, and contact areas 30, produce bats with different performance levels, feel, and sound upon barrel portion 9 impact with a ball. To produce the desired unique soft bat feel and sound upon impact, the ideal thickness 23 of the air cavities 22 has been found by field testing to be 0.020" to 0.050" which is considerably thicker than prior art bats, where any such air spaces exist only due to manufacturing tolerances of the frame 16 and secondary member 13. The air cavities 22 of the present invention can be filled with an elastomeric material with further performance, feel, and sound effects. Such prior art secondary members 13 do not have variable outer diameters. Due to the variable outer diameter 25, all bats of FIG. 12 can have variable radial stiffness along the barrel length 1. However, when the frame 16 and/or the primary secondary member 13 is made with composite materials, fiber types and laminating angles can be manipulated to achieve either constant or variable radial stiffness along the barrel length 1 regardless of dimensional variations.

As seen in FIGS. 12A through 12F bats of the present invention are further characterized by the inventive primary secondary member 13 having a variable outer diameter 25 and a variable inner diameter 29. The variable outer diameter 25 of the insert 13 produces variations in the surface profile of the insert 13 which are generally reflected by a corresponding profile on the inner surface 53 of the insert 13 wall. The resulting total bat wall thickness 6 variations along the barrel length 1 vary the performance, feel, and sound of the bats of FIGS. 12A through 12F.

Figure 12A:
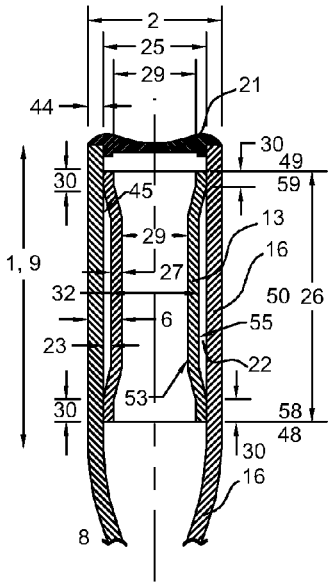
FIG. 12A shows a longitudinal cross-section of the barrel portion of one embodiment of the present invention showing a double wall tubular bat with an external frame and a primary secondary member, or insert, located internally within the frame wherein the primary secondary member has an outer diameter which varies along the length of the member, a constant wall thickness, two contact regions with the frame barrel portion inner surface, and one air cavity that is closed at both ends.

The bat variant of FIG. 12A has a single annular air cavity 22 where the external frame 16 wall acts independently of the insert 13 wall until the contact force between the ball and the external frame 16 increases enough to deflect the external frame inner surface 45 into contact with the insert's outer surface 55. At that point, the two members 16 and 13 act together, thus creating a non-linear spring. This decreases the peak contact force between the ball and the bat, which reduces the energy losses in the ball, and therefore improves performance.

Figure 12B:
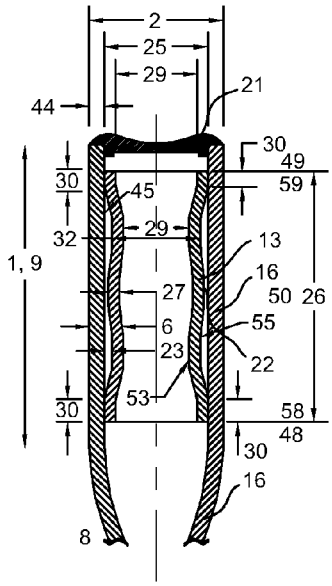
FIG. 12B shows a variant of the bat of FIG. 12A wherein the primary secondary member has a constant wall thickness, there are two contact regions, and one closed air cavity, wherein the thickness of the air cavity is reduced generally in the area of the barrel mid portion.

The bat variant of FIG. 12B has an insert 13 outside diameter 25 which increases near the barrel mid-portion 50, narrowing the air cavity 22 thickness. This reduces the performance improvement due to the effect of the gap, discussed in the previous paragraph, near the mid-portion 50 of the barrel length 1 and therefore gives a more uniform bat performance along the barrel length 1.

Figure 12C:
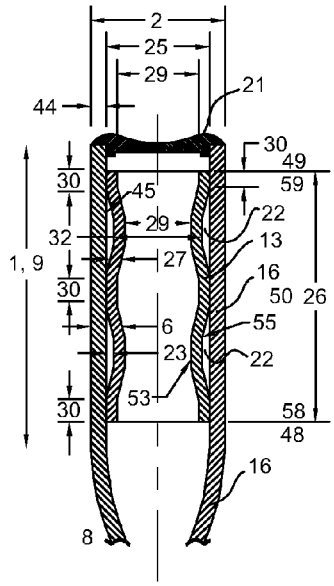
FIG. 12C shows a variant of the bat of FIG. 12A wherein the primary secondary member has a constant wall thickness, there are three contact regions and two closed air cavities.

The bat variant of FIG. 12C is similar to 12B where the insert 13 makes contact with the frame 16 inner surface 45 near the mid-portion 50 of the barrel length 1 at the insert 13 proximal 58 and distal 59 portions near the barrel ends. This eliminates the performance improvement imparted on the bat by the air cavity 22 at the barrel mid-portion 50, but creates two independent annular air cavities 22 away from the barrel mid-portion 50.

Figure 12D:
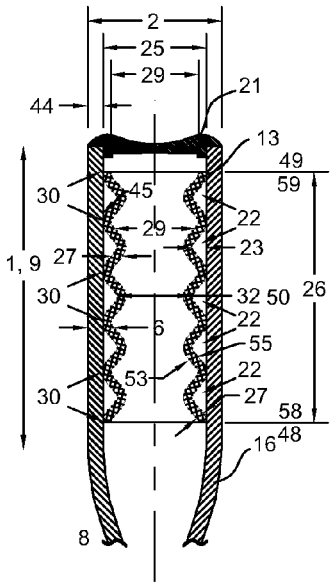
FIG. 12D shows a variant of the bat of FIG. 12A wherein the primary secondary member has a constant wall thickness and the outer diameter of the primary secondary member oscillates periodically along its length between a maximum and a minimum diameter, creating multiple contact regions and multiple closed air cavities.

The bat variant of FIG. 12D has an insert 13 where the outside diameter 25 oscillates, or varies periodically along the barrel length 1. When the period of the oscillations is reduced the insert 13 becomes stiffer and stronger for a given weight, or lighter for a given stiffness. The radial stiffness of the insert 13 increases with increased insert wall thickness 27, reduced period of oscillation, or increased magnitude of oscillation.

Figure 12E:
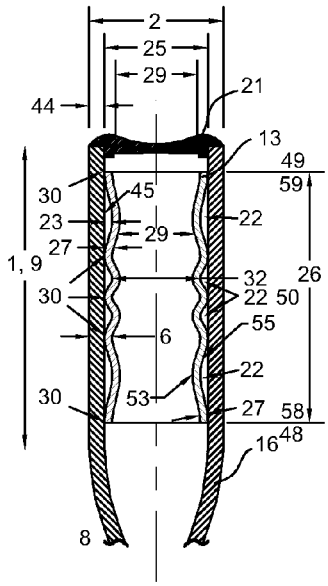
FIG. 12E shows a variant of the bat of FIG. 12D wherein the period of the oscillation of outside diameter of the primary secondary member increases away from the barrel mid portion.

The bat variant of FIG. 12E has an insert 13 where the outside diameter 25 oscillates, or varies periodically along the barrel length 1, and where the period of the oscillation increases away from the mid-portion 50 of the barrel length 1. The resultant reduced radial stiffness away from the sweet-spot creates a more uniform performance along the barrel length 1.

Figure 12F:
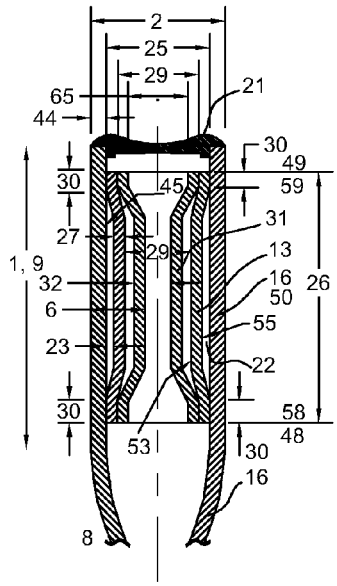
FIG. 12F shows a variant of the bat of FIG. 12A with a primary secondary member and an additional secondary member located internally to the primary secondary member wherein both secondary members have outer diameters which vary along the length of the secondary members, have constant wall thicknesses, two contact regions each, and one closed air cavity each.
Figure 12G:
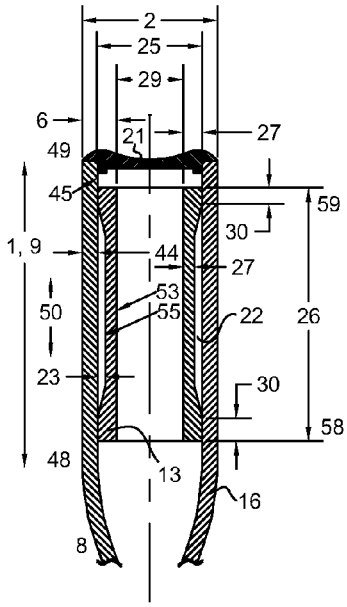
FIG. 12G shows a variant of the bat of FIG. 12A wherein the primary secondary member has a constant diameter internal surface, a non-constant diameter external surface, a non-constant wall thickness, two contact regions with the internal frame wall, and one air cavity that is closed at both ends.
Figure 12H:
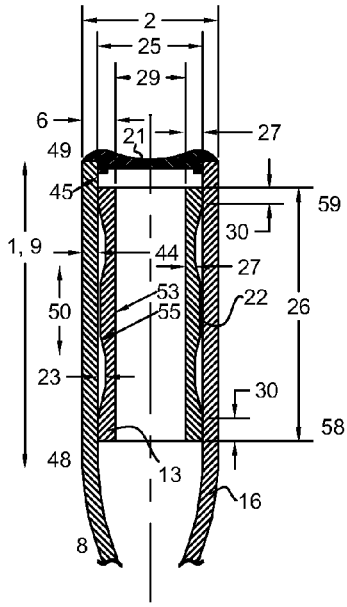
FIG. 12H shows a variant of the bat of FIG. 12G wherein the primary secondary member has two contact regions and one closed air cavity that has a non-uniform cross-section.
Figure 12I:
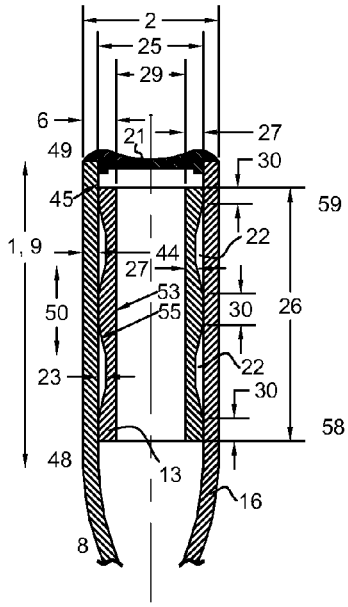
FIG. 12I shows a variant of the bat of FIG. 12G wherein the primary secondary member has three contact regions and two closed air cavities.
Figure 12J:
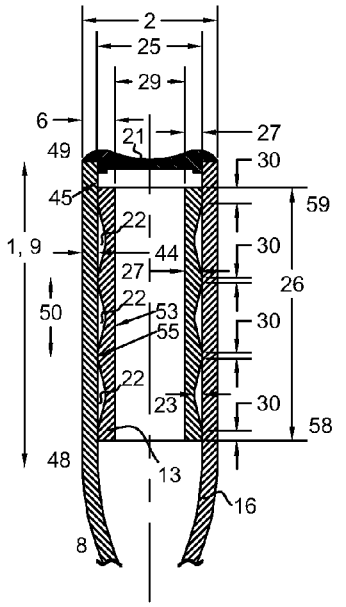
FIG. 12J shows a variant of the bat of FIG. 12D wherein the primary secondary member has a constant diameter internal surface.
Figure 12K:
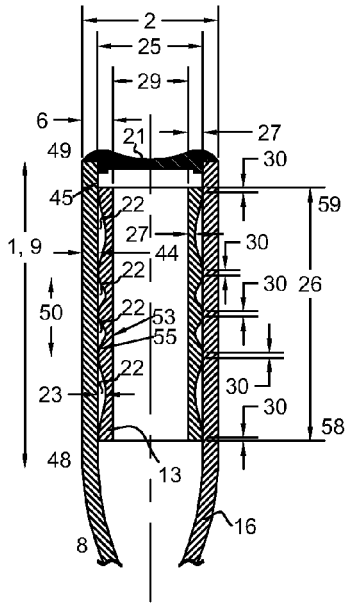
FIG. 12K shows a variant of the bat of FIG. 12E wherein the primary secondary member has a constant diameter internal surface.
Figure 12L:
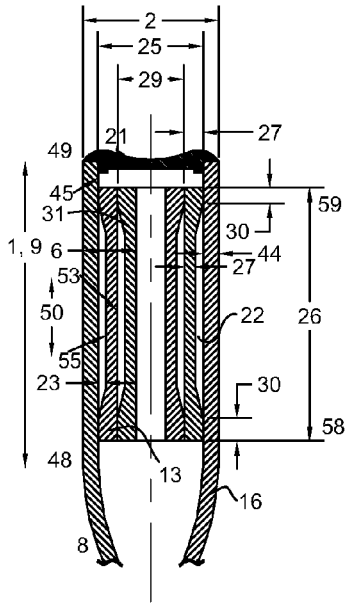
FIG. 12L shows a variant of the bat of FIG. 12F wherein the primary secondary member has a constant diameter internal surface.

The bat variant of FIG. 12F is a triple wall version of the bat of FIG. 12A created by an additional secondary member 31. Though not shown, additional such members could be added to create a multi-wall bat with more than three walls. Similarly, though not shown, additional secondary members 31 of any configuration could be added to the bats of FIGS. 12B, 12C, 12D, and 12E.

FIGS. 12G through 12L depict bats characterized by an inventive primary secondary member 13 with a variable outer diameter 25 and a constant inner diameter 29 along the barrel length 1. Otherwise, the bat variants of FIGS. 12G through L are similar to the bat variants of FIGS. 12A through F.

In another embodiment of the present invention, the bats of FIG. 13 have two or more independent annular, or ring-like, secondary members 61 of similar cross-section shape of variable dimensions with individual length 62, along the barrel portion 19, less than one-half the barrel portion length 1 and are internally located along the inner surface 45 of the external frame 16. The annular secondary members 61 have a length 62, a wall thickness 63, an inner surface 64, an inner diameter 65, an outer surface 66, and an outer diameter 67.

Figure 13A:
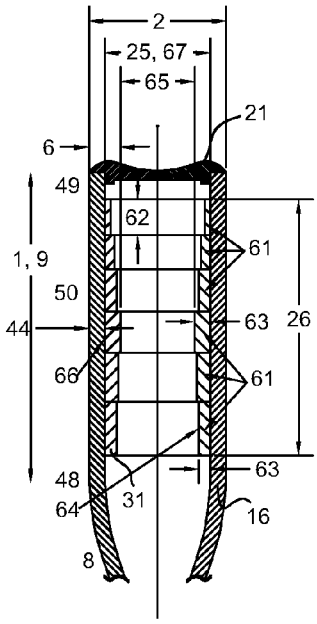
FIG. 13A shows a longitudinal cross-section of the barrel portion of a second embodiment of the present invention showing a double wall tubular bat with an external frame, and six independent annular secondary members, or rings, each of length less than one-half the frame barrel portion length and varying thickness, each internally located side by side, with or without spaces between, along the frame barrel portion length against the barrel portion inner surface of the external bat frame.

The bat variant of FIG. 13A has the external frame 16 reinforced by a series of independent inner annular secondary members 61 generally in the form of annular rings. The secondary members 61 have a common outer diameter 67 which is equal to or less than the inner diameter 25 of the frame 16 and are generally thicker near the barrel mid-portion 50 of the barrel length 1 and thinner away from it. The rings 61 are generally thicker towards the barrel distal end 49 and thinner towards the barrel proximal end 48 because the bat is moving faster at the distal end 49. Although not shown, the annular secondary members 61 could be of constant thickness and have varying material properties to accomplish varying radial stiffness and resultant more uniform performance.

Figure 13B:
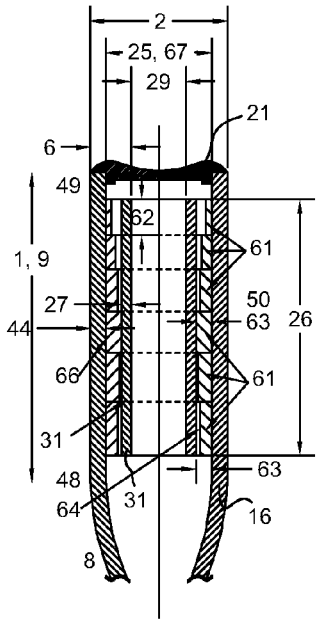
FIG. 13B shows a multi-wall bat variant of the bat of FIG. 13A wherein there are six independent annular secondary members each of length less than one-half the frame barrel portion length, each internally located along the frame inner wall surface, and a tubular additional secondary member with length approaching the frame barrel portion length and located internally to the annular secondary members and in contact with at least one annular secondary member, generally extending co-extensively with the frame barrel portion.

The bat variant of FIG. 13B has an external frame 16 reinforced by a series of independent annular secondary members 61 in the form of annular rings, in combination with an inner additional secondary continuous member 31 extending along the majority of the barrel length 1. The annular secondary members 61 provide a more uniform bat performance along the barrel length, while the inner additional secondary member 31 supports the impact force.

Figure 13C:
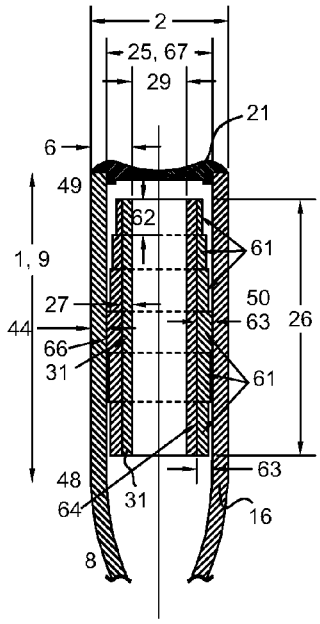
FIG. 13C shows a variant of the bat of FIG. 13B wherein there are six independent annular secondary members each of length less than one-half the frame barrel portion length, each internally located along the additional secondary member outer wall surface and internally to the external frame inner wall surface.

The bat variant of FIG. 13C is similar to that of 13B; however, the annular secondary members 61 have a constant inner diameter 29.

Figure 13D:
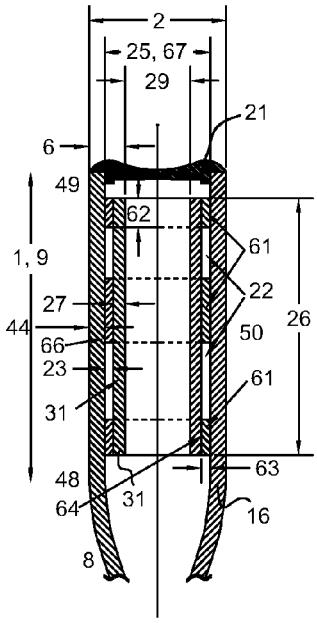
FIG. 13D shows a variant of the bat of FIG. 13B wherein there are three independent annular secondary members of constant thickness each internally located between and abutting against the external frame inner wall surface and the additional secondary member outer wall surface forming three closed air cavities.

The bat variant of FIG. 13D has internal annular secondary members 61 with a uniform inner diameter 29 and outer diameter 25, which create closed air cavities 22.

Figure 13E:
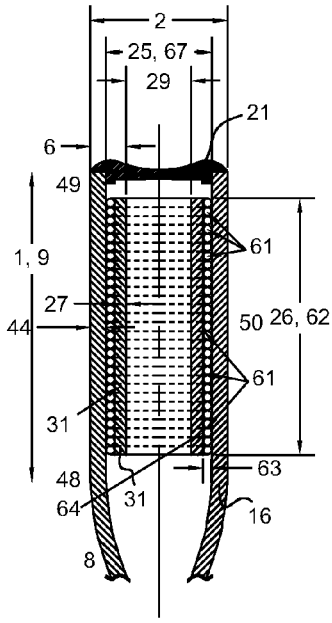
FIG. 13E shows a variant of the back of FIG. 13D wherein there are multiple annular secondary members with or without multiple air cavities.

The bat variant of FIG. 13E has an external frame 16 and axially continuous inner additional secondary member 31 with a series of annular secondary members 61 between the two. One candidate for the intermediate members 61 is a series of elastomeric O-rings with higher stiffness near the barrel mid portion 50.

Figure 13F:
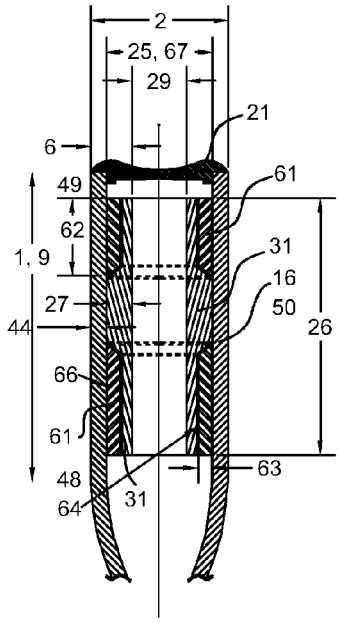
FIG. 13F shows a longitudinal cross-section of the barrel portion of another embodiment of the present invention showing a multi-wall tubular bat with an external frame, and two annular secondary members, or rings, each of length less than one-half the frame barrel portion length, wherein each annular secondary member is located between the outer frame and an additional secondary member with length approaching the frame barrel portion length, wherein the wall of the additional secondary member is thickest generally in the frame barrel mid portion providing a contact area between the inner surface of the frame and the outer surface of the additional secondary member.

The bat variant of FIG. 13F has an axially continuous inner additional secondary member 31 that is thicker in its mid-portion and could, or could not be, in contact with the external frame 16 near the barrel mid-portion 50 and has a reduced outer diameter at the barrel proximal 48 and distal 49 ends. The bat has two or more annular secondary members 61 located at the barrel portion 9 proximal 48 and diesel 49 ends. In effect, this bat is double walled at the barrel mid-portion 50 and triple walled away from the barrel mid-portion 50, giving more uniform bat performance along the barrel length 1 resulting in a broadened sweetspot.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

CONCLUSION

The foregoing has constituted a description of specific embodiments showing how the invention may be applied and put into use. These embodiments are only exemplary. The invention in its broadest, more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

We claim:

1. A bat for striking a ball comprising a substantially tubular frame extending along a longitudinal axis, with a handle portion for gripping, a barrel portion for striking, and a support taper portion connecting the handle and the barrel portions, the barrel portion of the frame having a barrel wall with an inner surface and inner diameter and an outer surface and outer diameter, the barrel wall having a constant wall thickness throughout an entire length of the barrel wall, the bat further comprising: a tubular primary secondary member, the secondary member having a wall with an inner surface and inner diameter and an outer surface and outer diameter, the secondary member wall extending co-extensively with at least a portion of the frame barrel wall; and the bat further comprising two or more annular secondary members, each annular member having a wall with an inner surface and inner diameter and an outer surface and outer diameter, extending co-extensively with the secondary member for at least a portion of the secondary member length; and the barrel portion of the frame and the secondary and annular members all having proximal and distal ends where the proximal end is closer to the handle portion of the frame, wherein a) at each axial position along the portion of the bat that contains the secondary member the secondary member wall outer diameter is less than or equal to the frame barrel wall inner diameter;

b) the secondary member wall outer surface is adjacent to the frame barrel wall inner surface near the barrel mid-portion of the frame barrel wall;

c) for some portion of the length of each annular member the annular member wall inner diameter is greater than or equal to the secondary member wall outer diameter and the annular member wall outer diameter is less than or equal to the frame barrel wall inner diameter, making the annular member wall intermediate to the secondary member wall and the frame barrel wall;

d) the entirety of at least one annular member is axially located between the proximal end of the frame and the region where the secondary member wall outer surface is adjacent to the frame barrel wall inner surface, and the entirety of at least one annular member is axially located between the distal end of the frame and the central region where the secondary member wall outer surface is adjacent to the frame barrel wall inner surface; and e) the tubular secondary member and annular secondary members are fitted into the tubular frame.

2. A bat for striking a ball as in claim 1 wherein the length of each intermediate annular member is less than one-half of the length of the secondary member.

3. A bat for striking a ball as in claim 1 wherein the wall of each annular member is intermediate to the secondary member wall and the frame barrel wall for the entire length of that annular member.

4. A bat for striking a ball as in claim 1 wherein some or all of the annular members are made of an elastomeric material.

5. A bat for striking a ball as in claim 1 wherein the secondary member is adhesively bonded to the external frame.

6. A bat for striking a ball as in claim 1 wherein the secondary member wall outer surface is adjacent to the frame barrel wall inner surface near the barrel mid-portion of the frame barrel wall.

* * * * *